United States Patent [19]

Korenberg

[11] Patent Number: 4,688,521

[45] Date of Patent: Aug. 25, 1987

[54] TWO STAGE CIRCULATING FLUIDIZED BED REACTOR AND METHOD OF OPERATING THE REACTOR

[75] Inventor: Jacob Korenberg, York, Pa.

[73] Assignee: Donlee Technologies Inc., York, Pa.

[21] Appl. No.: 868,055

[22] Filed: May 29, 1986

[51] Int. Cl.[4] ..... F22B 1/00

[52] U.S. Cl. ..... 122/4 D; 110/245; 110/263; 110/346; 110/347

[58] Field of Search ..... 110/245, 263, 346, 347; 122/4 D; 34/57 A; 432/15, 58; 60/39, 464; 165/104, 16; 431/7, 170

[56] References Cited

U.S. PATENT DOCUMENTS

| | | | |
|---|---|---|---|
| 3,897,739 | 8/1975 | Goldbach | 110/245 X |
| 4,457,289 | 7/1984 | Korenberg | 110/245 X |
| 4,469,050 | 9/1984 | Korenberg | 110/245 X |
| 4,548,138 | 10/1985 | Korenberg | 110/245 |
| 4,565,139 | 1/1986 | Sage et al. | 122/4 D X |
| 4,594,967 | 6/1986 | Wolowodiuk | 110/245 X |
| 4,617,877 | 10/1986 | Gamble | 110/245 X |

OTHER PUBLICATIONS

N. Syred and J. M. Beer, Combustion and Flame, vol. 23, pp. 143–201, copyright 1974, The Combustion Institute, published by American Elsevier Publishing Company, Inc.

*Primary Examiner*—Albert J. Makay
*Assistant Examiner*—Steven E. Warner
*Attorney, Agent, or Firm*—Finnegan, Henderson, Farabow, Garrett and Dunner

[57] ABSTRACT

A method of operating a circulating fluidized bed combustion reactor includes providing a reactor with an upright combustion chamber and an upright and cylindrical cyclonic combustor, feeding in combustible matter, supplying first and second streams of pressurized air, permitting combustion product gases to exit while retaining and returning granular material and uncombusted matter to the lower region of the combustion chamber and controlling the various flows.

29 Claims, 13 Drawing Figures

TWO STAGE CIRCULATING FLUIDIZED BED REACTOR AND METHOD OF OPERATING THE REACTOR

BACKGROUND OF THE INVENTION

The present invention relates to an improved circulating, i.e., fast, fluidized bed reactor having two stages, namely, a circulating fluidized bed reaction stage and a cyclonic reaction stage downstream of the fluidized bed; and to a method of operating the reactor. More particularly, the invention relates to a two stage circulating fluidized bed reactor in which the size of the fluidized bed reaction chamber and the cyclonic reaction vessel are substantially reduced.

The present invention has specific application, inter alia, to adiabatic fluidized bed combustors, fluidized bed boilers, and compressed hot air generators. As used herein, and in the accompanying claims, "adiabatic combustor" denotes a fluidized bed combustor that does not contain internal cooling means, and "boiler" denotes a fluidized bed combustor that contains internal heat absorption means, in the form of boiler, superheater, evaporator, and/or economizer heat exchange surfaces. The temperature of adiabatic fluidized bed combustors is typically controlled by the use of pressurized air in substantial excess of the stoichiometric amount needed for combustion. On the other hand, fluidized bed boilers require very low excess air, so that heat absorption means are required in the fluidized bed. Fluidized bed gasifiers, in contrast, utilize less than stoichiometric amounts of air.

The state of fluidization in a fluidized bed of solid particles is primarily dependent upon the diameter of the particles and the fluidizing gas velocity. At relatively low fluidizing gas velocities exceeding the minimum fluidizing velocity, the bed of particles is in what has been termed the "bubbling" regime. Historically, the term "fluidized bed" has denoted operation in the bubbling regime. This fluidization mode is generally characterized by a relatively dense bed having an essentially distinct upper bed surface, with little entrainment, or carryover, of the bed particles (solids) in the flue gas, so that recycling the solids is generally unnecessary. At higher fluidizing gas velocities, above those of the bubbling regime, the upper surface of the bed becomes progressively diffuse and carry-over of the solids increases, so that recirculation of solids using a particulate separator, e.g., a cyclone separator, becomes necessary in order to preserve a constant solids inventory in the bed.

The amount of solids carry-over depends upon the fluidizing gas velocity and the distance above the bed at which the carry-over occurs. If this distance is above the transfer disengaging height, carry-over is maintained at a constant level, as if the fluidizing gas were "saturated" with solids.

If the fluidizing gas velocity is increased above that of the bubbling regime, the bed then enters what has been termed the "turbulent" regime, and finally, the "fast," i.e., "circulating" regime. If a given solids inventory is maintained in the bed, and the fluidizing gas velocity is increased just above that of the turbulent regime, the bed density drops sharply over a narrow velocity range. Obviously, if a constant solids inventory is to be preserved in the bed, the recirculation, or return, of solids must equal the carry-over at "saturation."

At fluidizing gas velocities below those associated with the aforementioned sharp drop in bed density, the effect upon bed density of returning solids to the fluidized bed at a rate well above the "saturation" carry-over is not marked. The addition of solids to a bed fluidized in either the bubbling or turbulent regime at a rate above the saturation carry-over will simply cause the vessel containing the fluidized bed to fill up continually, while the fluidized density will remain substantially constant. However, at the higher fluidizing gas velocities associated with the circulating regime, the fluidized density becomes a marked function of the solids recirculation rate.

Circulating fluidized beds afford intimate contact between the high velocity fluidizing gas and large inventory of solids surface per unit bed volume. Additionally, slip velocity (i.e., solids-fluidizing gas relative velocity) is relatively high in circulating fluidized beds, when compared with that in ordinary fluidized beds. Consequently, there is generally a very high level of particulate loading in the combustion gases exiting from circulating fluidized bed combustors. The combustion process which takes place in a circulating fluidized bed combustor is also generally more intense, having a higher combustion rate than that occurring in traditional fluidized bed combustors. Furthermore, as a result of the high solids recirculation rate in circulating fluidized beds, the temperature is essentially uniform over the entire height of such combustors.

Conventional circulating fluidized bed combustors operate at gas superficial velocities many times higher than the terminal velocity of the fluidized bed mean particle. Consequently, there is a very high particulate loading in the combustion product gases exiting from the combustor and entering the downstream cyclone particle separator. Such conventional cyclone particle separators typically have a height which is roughly three times their diameter, so that separators having a large diameter designed to remove the entrained solids from circulating fluidized bed combustors are typically quite tall and bulky. Such large refractory coned cyclone particle separators constitute a significant portion of the total cost of conventional circulating fluidized bed combustor systems.

Notwithstanding the many advantages offered by conventional circulating fluidized bed reactors, as enumerated above, the high cost of constructing and maintaining the extremely large cyclone particle (gas-solids) separators required for recirculation of the entrained solids at the rate necessary to maintain the bed in the circulating fluidization regime constitutes a severe economic impediment to widespread commercial utilization of such reactors.

Prior art circulating fluidized bed combustor boilers are known which employ vertical heat exchanger tube-lined walls in the entrainment region of the combustor (i.e., parallel to the flow). Such combustors rely primarily on the transfer of heat from gases which typically are heavily laden with solids, and require an extremely large internal volume to accomodate the large heat transfer surface required.

The tube-lined wall heat transfer surface installed in the free board region in conventional fluidized bed combustors necessarily possesses a significantly lower heat transfer coefficient than that of a heat transfer fully immersed in the fluidized bed. Furthermore, its heat transfer coefficient is dependent primarily on two parameters: (a) fluidizing gas velocity, and (b) particle concentration in the flue gases, i.e., particle loading. The latter parameter is, in turn, strongly dependent on the fluidizing gas velocity and the mean particle size of the fluidized bed material. The concentration of particles in the ascending gas flow in a conventional circulating fluidized bed combustor is directly proportional to the gas velocity to the 3.5–4.5 power, approximately, and inversely proportional to the fluidized bed mean particle diameter to the 3.0 power, approximately. The strong effect of, and careful attention to, these two parameters on the concentration of particles in the ascending gas flow helps to achieve a reasonable heat transfer coefficient for conventional tube-lined wall heat transfer surfaces in the free board region and facilitates the control of combustion temperature at nominal and reduced boiler capacity. Nevertheless, there is a need in the art for a fluidized bed combustor boiler having a reasonable heat transfer coefficient and permitting control of combustion temperature at nominal and reduced capacity without being so strongly dependent on fluidizing gas velocity and fluidized bed mean particle diameter.

The height of the free board region of a conventional circulating fluidized bed combustor boiler having a tube-lined wall heat transfer surface as described above is directly proportional to the superficial gas velocity to the 0.5 power and inversely proportional to the surface's heat transfer coefficient. Also, it can be shown that the particle loading and heat transfer coefficient are directly proportional to any change in the superficial gas velocity. The latter fact means that, for instance, a reduction of the superficial gas velocity will require an incease in the free board height for such a conventional combustor of a given capacity. Similarly, it can be shown that in order to increase the capacity of such a combustor, the free board height must be increased, thereby significantly increasing the cost of constructing such a higher capacity combustor.

In contrast to most conventional circulating fluidized bed combustors, the combustor disclosed in U.S. Pat. No. 4,469,050 to Korenberg (assigned to a common assignee herewith) does not provide for transferring the entrained granular bed material, unburnt fuel, ash, gases, etc. directly into a cyclone particle separator. Rather, the entrained solids and gases are carried upward into a cylindrically shaped upper region of the combustor chamber, i.e., an extended free board region, where further combustion takes place. Vertical rows of tangential nozzles are built into and evenly spaced over this cylindrical upper free board region. This tangentially fed secondary air is supplied at a sufficient velocity, and the geometric characteristics of the cylindrical upper region are adapted, to provide a Swirl number (S) of at least about 0.6 and a Reynolds number (Re) of at least about 18,000 within such upper region, which are required to create a cyclone of turbulence.

This cyclone of turbulence enables the combustor shown in U.S. Pat. No. 4,469,050 to achieve specific heat releases higher than 1.5 million Kcal per cubic meter per hour, thereby significantly increasing the rate of combustion. As a direct result, the "vessel" size of this combustor is significantly smaller than other prior art combustors. Essentially, compared to its downstream cyclone particle separator, the combustor vessel appears like a refractory-lined duct.

The relatively large size of the cyclone particle separator compared to the combustor vessel produced an incentive for improving this system by eliminating the cyclone particle separator. This was achieved in the circulating fluidized bed combustor disclosed in U.S. Pat. No. 4,457,289 to Korenberg (assigned to a common assignee herewith) by eliminating the entire external solids recirculation loop and utilizing "internal recirculation." To achieve this, a "throat" was inserted at the top of the cylindrical upper region of the combustor and the external cyclone separator was eliminated.

The combustor disclosed in U.S. Pat. No. 4,457,289 is significantly less expensive to construct than the combustor disclosed in U.S. Pat. No. 4,469,050, and other prior art circulating fluidized bed combustors, since it does not require a separate cyclone particle separator. However, it has demonstrated a somewhat reduced particulate capturing efficiency compared to such other combustors, particularly when burning solid coal particles. Furthermore, the combustor disclosed in U.S. Pat. No., 4,457,289 provides a residence time for solid coal particles and conventional sulfur absorbents which, in some cases, may be less than optimum for capturing any sulfur in the coal.

In conventional, non-circulating and circulating fluidized bed reactors for combusting particulate material, the material to be combusted is fed in or over a bed of granular material, usually fuel ash, sulfur absorbents such as limestone, and/or sand.

SUMMARY OF THE INVENTION

The present invention, in a radical departure from the conventional circulating fluidized bed reactors discussed above, has overcome the above-enumerated problems and disadvantages of the prior art by providing a two stage circulating fluidized bed reactor having a fluidized bed reaction (e.g., combustion) stage followed by a cyclonic reaction (e.g., cyclonic combustion) stage. A minor portion of the reaction gases (e.g., air) is supplied beneath the fluidized bed as fluidizing gases, while a major portion of the gases is supplied into the cyclonic reaction stage. Such major portion of the gases is fed tangentially into an upright cylindrically shaped cyclonic reaction vessel so as to create a cyclone of high turbulence, whereby the reaction takes place in both the fluidized bed and the cyclonic reaction vessel at a significantly increased rate. The solids entrained in the fluidized bed stage are carried over into the cyclonic reaction vessel where they are separated from the gases therein and recycled back into the fluidized bed.

It is an object of the invention to provide a circulating fluidized bed reactor utilizing a cyclonic reaction stage which provides a cyclone of turbulent gases having a Swirl number of at least about 0.6 and a Reynolds number of at least about 18,000 in a cylindrically shaped, refractory lined cyclonic reaction vessel downstream of the fluidized bed, thereby providing a significantly improved reaction rate and requiring a significantly lower volume of gases and solids circulating from the fluidized bed to the cyclonic reaction vessel. Consequently, the size of the reactor of the present invention is significantly smaller than prior art circulating fluidized bed reactors. Specifically, the height and internal diameter of the free board region of the fluidized bed and the height and internal diameter of the cyclonic reaction vessel of the present invention are significantly reduced, compared to the fluidized bed free board region and cyclone particles separator, respectively, of a conventional circulating fluidized bed reactor having the same reactor capacity.

A further object is to provide a reactor having a shorter fluidizing gas residence time required to complete the reaction to the desired level. Specific heat releases in excess of about 1.5 million Kcal per cubic meter per hour are believed to be obtainable according to the present invention.

The foregoing advantages will permit a significant reduction in the size and, thus, the cost of constructing the circulating fluidized bed reactor of the present invention. This will be true in adiabatic combustor and boiler applications of the invention. It is anticipated, for example, that several times less internal volume will be required for a combustor constructed in accordance with the present invention, and for boiler applications, at least about 3–5 times less heat transfer surface area will be needed for the combustion stage.

Still another object of the invention is to provide an improved boiler system having a high turndown ratio and easier start-up than prior art systems. It is an additional object of the invention in this regard to provide a separate cooling fluidized bed adjacent to the circulating fluidized bed for removing heat from the combustion stage by cooling the solids in the cooling fluidized bed and then recycling them back to the combustion stage. The cooling fluidized bed is preferably fluidized in the bubbling regime and contains evaporator, superheater and/or economizer coils immersed in the bubbling fluidized bed with the further objective of significantly reducing the heat exchanger surface area required for effective heat transfer. In such an overall system (circulating fluidized bed reactor with adjacent bubbling fluidized bed heat exchanger), it is a further objective to eliminate the vertical heat exchanger tube-lined walls previously utilized in the upper region (vapor space) of prior art circulating fluidized bed reactors, thereby considerably reducing the cost of constructing such a system.

To achieve the objects and in accordance with the purposes of the invention, as embodied and broadly described herein, a method of operating a circulating fluidized bed combustion reactor according to the invention comprises: (a) providing a substantially enclosed combustion reactor containing a fluidized bed of granular material, the reactor comprising a substantially upright combustion chamber and a substantially upright and cylindrical cyclonic combustor vessel adjacent to the chamber, the respective upper regions of the chamber and the vessel being connected via a conduit and the respective lower regions of the chamber and the vessel being operatively connected, the vessel having a cylindrically shaped exit throat aligned substantially concentrically with, and at the top of, the vessel; (b) feeding combustible matter into the combustion chamber; (c) supplying the first stream of pressurized air to the reactor through a plurality of openings at the bottom of the combustion chamber at a sufficient velocity to fluidize the granular material and the matter in the circulating regime for combusting a minor portion of the matter in the chamber, whereby a substantial portion of the granular bed material, combustion product gases and uncombusted matter are continually entrained out of the chamber and into the cyclonic combustor vessel via the conduit; (d) tangentially supplying a second stream of pressurized air into the reactor through a plurality of openings in the cylindrically shaped interior side wall of the vessel for cyclonic combustion of a major portion of the combustible matter in the vessel, the second stream being supplied, and the vessel being constructed and operated, so as to produce a Swirl number of at least about 0.6 and a Reynolds number of at least about 18,000 within the vessel for creating a cyclone of turbulence therein having at least one internal reverse flow zone, thereby increasing the rate of combustion therein; (e) permitting the combustion product gases generated in the reactor to exit from the reactor via the exit throat in the cyclonic combustor vessel, while retaining substantially all of the granular material and uncombusted matter within the reactor; (f) collecting the granular bed material and any uncombusted matter in the lower region of the cyclonic combustor vessel and returning it to the lower region of the combustion chamber; and (g) controlling the combustion process in the reactor by controlling the flow of the first and second streams of air into the combustion chamber and the cyclonic combustor vessel, respectively, and by controlling the flow of granular bed material and matter to be combusted in the chamber and the vessel.

The method of the present invention may be performed in an adiabatic mode, in which the total pressurized air supplied is in excess of the stoichiometric amount needed for combustion; or in a non-adiabatic mode in which a heat exchange surface is provided in the fluidized bed for removing heat from the bed.

A method of operating a circulating fluidized bed combustion reactor according to a further embodiment of the invention comprises: (1) providing a substantially enclosed combustion reactor comprising: (a) a substantially upright combustion chamber containing a fluidized bed of granular material fluidized in the circulating regime, (b) a first cooling chamber adjacent to the combustion chamber and having a first heat exchange surface, (c) a second cooling chamber having a second heat exchange surface, the first and second cooling chambers having a common bubbling fluidized bed in their bottom regions, and (d) a substantially upright and cylindrical cyclonic combustor vessel adjacent and operatively connected to the second cooling chamber and operatively connected to the combustion chamber, the vessel having a cylindrically shaped exit throat aligned substantially concentrically with, and at the top of, the vessel; (2) permitting solids from the bubbling fluidized bed to flow into the circulating fluidized bed in the combustion chamber for controlling the temperature of the latter bed; (3) feeding combustible matter into the combustion chamber; (4) supplying a first stream of pressurized air to the reactor through a plurality of openings at the bottom of the combustion chamber at a sufficient velocity to fluidize the granular material and the matter in the circulating regime for combusting a minor portion of the matter in the combustion chamber, whereby a substantial portion of the granular bed material, combustion product gases and uncombusted matter are continually entrained upward and out of the chamber into the first cooling chamber; (5) passing the product gases and entrained solids downward through the first cooling chamber and removing heat therefrom via the first heat exchange surface, and permitting the entrained solids to enter the bubbling fluidized bed; (6) then passing the gases from the first cooling chamber to the second cooling chamber and permitting the gases to ascend through the second cooling chamber while removing heat therefrom via the second heat exchange surface; (7) entraining the solids containing the uncombusted matter in the ascending gases in the second cooling chamber and passing the gases and entrained solids out of the second cooling chamber and into the upper region of the cyclonic combustor vessel; (8) tangentially supplying a second stream of pressurized air into the reactor through a plurality openings in the cylindrically shaped interior side wall of the vessel for cyclonic combustion of a major portion of the combustible matter fed to the reactor in the vessel, the second stream being supplied, and the vessel being constructed and operated, so as to produce a Swirl number of at least about 0.6 and a Reynolds number of at least about 18,000 within the vessel for creating a cyclone of turbulence therein having at least one internal reverse flow zone, thereby increasing the rate of combustion therein; (9) permitting the combustion product gases generated in the reactor to exit from the reactor via the exit throat in the cyclonic combustor vessel, while retaining substantially all of the granular material and uncombined matter within the reactor; (10) collecting the granular bed material and any uncombusted matter in the lower region of the cyclonic combustor vessel and returning it to the combustion chamber; and (11) controlling the combustion process in the reactor by controlling the flow of the first and second streams of air into the combustion chamber and the cyclonic combustor vessel, respectively, and by controlling the flow of granular bed material and matter to be combusted in the combustion chamber, the first and second cooling chambers, and the vessel.

In addition to the above-described methods, the present invention is also directed to a circulating fluidized bed reactor comprising: (a) a substantially enclosed combustion reactor for containing a fluidized bed of granular material, the reactor comprising a substantially upright combustion chamber and a substantially upright and cylindrical cyclonic combustor vessel adjacent to the chamber, the respective upper regions of the chamber and the vessel being connected via a conduit and the respective lower regions of the chamber and the vessel being operatively connected; (b) means for feeding combustible matter into the combustion chamber; (c) means for supplying a first stream of pressurized air to the reactor through a plurality of openings at the bottom of the combustion chamber at a sufficient velocity to fluidize the granular material and the matter in the circulating regime for combusting a minor portion of the matter in the chamber, whereby a substantial portion of the granular bed material, combustion product gases and uncombusted matter are adapted to be continually entrained out of the chamber and into the cyclonic combustor vessel via the conduit; (d) means for tangentially supplying a second stream of pressurized air into the reactor through a plurality of openings in the cylindrically shaped interior side wall of the vessel for cyclonic combustion of a major portion of the combustible matter in the vessel, the vessel being constructed for producing a Swirl number of at least about 0.6 and a Reynolds number of at least about 18,000 within the vessel for creating a cyclone of turbulence therein having at least one internal reverse flow zone, thereby increasing the rate of combustion therein; (e) a cylindrically shaped exit throat aligned substantially concentrically with, and at the top of the vessel for permitting the combustion product gases generated in the reactor to exit from the reactor, while retaining substantially all of the granular material and uncombusted matter within the reactor; and (f) means for collecting the granular bed material and any uncombusted matter in the lower region of the cyclonic combustor vessel and returning it to the lower region of the combustion chamber.

The accompanying drawings, which are incorporated in and constitute a part of this specification, illustrate several embodiments of the invention and, together with the description, serve to explain the principles of the invention.

DESCRIPTION OF THE PREFERRED EMBODIMENTS

Reference will now be made in detail to the presently preferred embodiments of the invention, examples of which are illustrated in the accompanying drawings.

Figure 1:
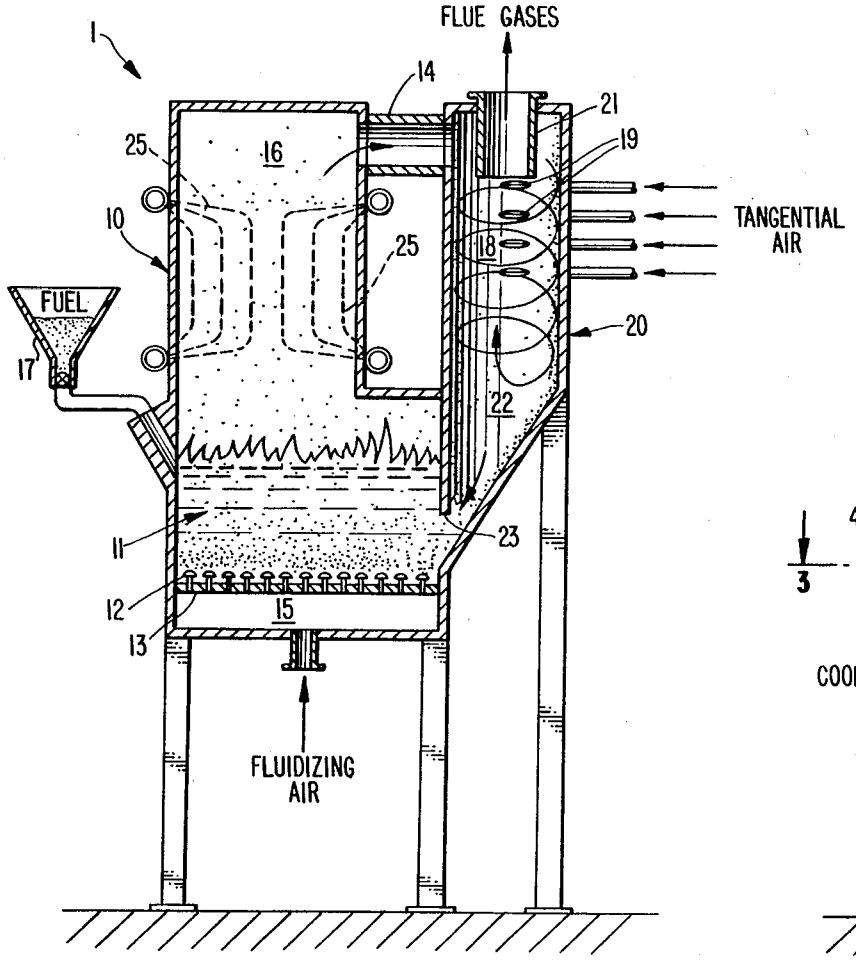
FIG. 1 is a diagrammatic vertical section view of an adiabatic circulating fluidized bed reactor constructed in accordance with the present invention.

One preferred embodiment of the circulating fluidized bed reactor of the present invention is shown in FIG. 1. As shown, the reactor of the present invention may comprise, for example, a combustor, represented generally by the numeral 1. In accordance with this embodiment of the invention, the combustor 1 includes a fluidized bed combustion chamber 10 containing a fluidized bed of granular material in its lower region 11. The granular bed material is preferably fly ash, sand, fine particles of limestone and/or inert materials.

The granular bed material is fluidized in the circulating fluidization regime with pressurized oxygen-containing gas, for example, air, which is supplied as stream through a plurality of fluidization nozzles 12 extending through support surface 13. At maximum operating capacity for the combustor, the air supplied through openings 12 preferably constitutes less than about 50%, and still more preferably between about 15–35%, of the total air supplied to combustor 1, i.e., the air required for the combustion process. As will be discussed in detail below, one of the primary objects of the invention, namely, the significant reduction in the size of the combustor 1 relative to conventional circulating fluidized bed combustors, is achieved primarily by feeding significantly reduced levels of air to the combustor as fluidizing air, i.e., through nozzles 12. Thus, although amounts of air in excess of 50% the total air supplied to combustor 1 can be fed via fluidization nozzles 12 in accordance with the present invention, the extent to which the size of combustor 1 can be reduced will be increased proportionately by reducing the amount of air supplied to combustor 1 as fluidizing air.

A source of pressurized air, e.g., a blower (not shown), preferably feeds the air to a plenum chamber 15 beneath support surface 13 or as shown in FIG. 1. Chamber 15 supplies the air to nozzles 12. A separate conduit (not shown) extends through support surface 13 for removing fuse, such as tramp material and/or agglomerated ash, etc., if required, from combustion chamber 10.

Combustor 1 further includes means for feeding combustible matter to the combustor, preferably to the lower region 11 of combustion chamber 10. As embodied herein, such means may comprise any suitable conventional mechanical or pneumatic feeding mechanism 17. The combustible matter which may comprise gases, liquids and/or solid particles, may be introduced into or above the bed in lower region 11 of combustion chamber 10. The combustible matter undergoes partial combustion in lower extentent to an extent limited by the free oxygen available in the fluidizing gas. The unburnt fuel, any gaseous volatile matter, and a portion of the granular bed material are carried upward (i.e., entrained) by the fluidizing gas and the flue gases into an upper region 16 of combustion chamber 10, and exit from upper region 16 through conduit 14 tangentially into the upper region 18 of adjacent cyclonic combustor vessel 20.

It is generally known that the quantity of particles transported by an ascending gas from a circulating fluidized bed is a function of the gas flow velocity to the third to fourth power. Thus, greater solids reaction surface can be achieved by: (a) maintaining maximum solids' saturation in the ascending gas flow, and (b) increasing the vertical velocity of the fluidizing gas to a desired level sufficient to provide the desired carry-over into upper region 18 of cyclonic combustor vessel 20. For any solid fuel having a given specific ash particle size distribution, this vertical gas velocity must be sufficiently high, as noted above, but must not be so high as to cause intensive erosion of the refractory liner in upper region 16 of combustion chamber 10, due to very high ash concentration in this region, as will be discussed below.

The interior surface of upper region 18 is cylindrically shaped in order to achieve swirling flow in such upper region, as discussed more fully below.

In accordance with the invention, means are provided for tangentially supplying a second stream of pressurized gas, e.g., air, to the upper region 18 of cyclonic combustor vessel 20 through openings 19, and preferably at least two oppositely disposed openings 19. Still more preferably, a plurality of openings 19 are provided at several aggregate points in upper region 18. As shown in FIG. 1, in one advantageous embodiment the plurality of oppositely disposed openings are vertically aligned and spaced apart throughout upper region 18. (The cross-sectional view shown in FIG. 1 necessarily depicts only one vertical row of openings.)

As embodied herein, a source of pressurized air, e.g., conventional blower (not shown) feeds the second stream of air to, for example, a conventional vertical manifold (not shown). In one preferred embodiment of the invention, the second stream of air constitutes between about 65%–85% of the total air fed to combustor 1, i.e., the total air flow required for the combustion process, at maximum combustor capacity.

In accordance with the invention, it is critical that the secondary air be supplied at a sufficient velocity, and that the geometric characteristics of the interior surface of upper region 18 of cyclonic combustor vessel 20 be adapted, to provide a Swirl number (S) of at least about 0.6 and a Reynolds number (Re) of at least about 18,000, which are required to create a cyclone of turbulence in upper region 18. Preferably, upper region 18 is constructed and operated in a manner adapted to yield these minimum values of Swirl number and Reynolds number when operating at maximum reactor capacity. On the other hand, the Swirl number and Reynolds number must not exceed those values which would result in an unacceptable pressure drop through vessel 20.

This cyclone of turbulence enables combustor 1 to achieve specific heat release values higher than about 1.5 million Kcal per cubic meter per hour, thereby significantly increasing the rate of combustion. As a result, the size of the chamber 10 and vessel 20 of the present invention can be significantly reduced, compared to the size of a conventional circulating fluidized bed combustor free board region and hot cyclone separator, respectively.

Cyclonic combustor vessel 20 is provided with a cylindrically shaped exit throat 21 aligned substantially concentrically with the cylindrical interior surface of upper region 18. Exit throat 21 and the interior of the upper region 18 of vessel 20 must exhibit certain geometric characteristics, together with the applicable gas velocities, in order to provide the above-noted required Swirl number and Reynolds number. These features are explained below and are discussed generally in "Combustion in Swirling Flows: A Review," N. Syred and J. M. Beer, Combustion And Flame, Vol. 23, p. 143–201, Copyright 1974 by The Combustion Institute, Published by American Elsevier Publishing Company, Inc., and the references noted therein, which publications are hereby specifically incorporated herein by reference.

The majority of the fuel combustion in combustor 1 preferably takes place in the cyclone of turbulence in upper region 18 of cyclonic combustor vessel 20 at a temperature below the fusion point, which provides a friable ash condition.

The cyclone of turbulence in upper region 18, and the accompanying large internal reverse flow zones created therein, when the cross-sectional area and length of upper region 18, the cross-sectional area of tangential openings 19, and the diameter of cylindrical exit throat 21 are properly sized (see below), effectively prevent all but the smallest solids from exiting from upper region 18 through exit throat 21.

In the embodiment shown in FIG. 1, the granular bed material ash and any unburnt fuel are collected in the lower region 22 of vessel 20 and allowed to descend under the force of gravity through port 23, returning to lower region 11 of combustion chamber 10, thus constantly increasing the height of the bed in lower region 11, if a fuel having a sensible amount of ash is burned. As a result, it will be necessary to frequently discharge these solids. The solids collected and not fluidized in lower region 22 of vessel 20 descend as a gravity bed effectively precluding any gas flow through port 23.

If the upper region 18 of vessel 20 is designed and operated so as to achieve a Swirl number of at least about 0.6 and a Reynolds number of at least about 18,000 therewithin, and the ratio of the diameter of the combustor exit throat 21 (De) to the diameter of upper region (Do), i.e., De/Do (defined herein as X), lies within the range of from about 0.4 to about 0.7, preferably about 0.5 to about 0.6, upper region 18 will, during operation, exhibit large internal reverse flow zones, with as many as three concentric toroidal recirculation zones being formed. Such recirculation zones are known generally in the field of conventional cyclone combustors (i.e., not involving fluidized beds), and reference is made to "Combustion in Swirling Flows: A Review", supra, and the references noted therein, for a general explanation of such phenomena. Such cyclonic flow and recirculation zones in upper region 18 act to separate the solids from the gases present in upper region 18. The very high level of turbulence in upper region 18 results in significantly improved combustion intensity and, as a result of improved solids-gas heat exchange, a substantially uniform temperature throughout cyclonic combustor vessel 20.

As mentioned, vessel 20 should be constructed such that the value of the ratio X lies within the range of from about 0.4 to about 0.7. The greater the value of X, the lesser the pressure drop through vessel 20 and the greater the Swirl number; so that, generally, higher values of X are preferred. However, for values of X in excess of about 0.7, the internal reverse flow zones are not formed sufficiently to provide adequate gas-solids separation.

Although the fluidized bed reactor of the present invention is fluidized in the "circulating" or "fast" fluidization regime, it differs fundamentally from prior art circulating fluidized bed reactors, in that: (a) it does not require the use of a large cyclone particle separator to separate the fluidized solids, e.g., the granular bed material, unburnt fuel, ash, etc., from the flue gases, and (b) there is a significantly reduced gas flow through upper region 16 of combustion chamber 10 and into cyclonic combustor vessel 20 which, thus, can be of a smaller size. The elimination of the requirement for large cyclone separators and the reduced size of chamber 10 and vessel 20 will significantly reduce the size and the cost of reactor systems constructed in accordance with the present invention.

In operation, the combustible matter is fed into combustion chamber 10. Optionally, for gaseous or liquid fuels, all or a portion of the combustible matter may be fed directly into cyclonic combustor vessel 20, preferably via tangential openings 19.

The first stream of pressurized air is supplied to chamber 10 through fluidizing nozzles 12 at a sufficient velocity to fluidize the granular bed material and combustible matter in the circulating regime for combusting a portion of the combustible matter in chamber 10. A substantial portion of the granular bed material, combustion product gases and uncombusted matter are continually entrained out of chamber 10 and into cyclonic combustor vessel 20 via tangential conduit 14.

The second stream of pressurized air is supplied tangentially to vessel 20 through openings 19 in the cylindically shaped interior side wall of the upper region 18 of vessel 20 for cyclonic combustion of a major portion, for example, greater than about 50% and preferably between about 65% and 85%, of the uncombusted matter in vessel 20.

The second stream of air is supplied, and vessel 20 is constructed and operated, so as to produce a Swirl number of at least about 0.6 and a Reynolds number of at least about 18,000 within vessel 20 for creating a cyclone of turbulence therein having at least one internal reverse flow zone, thereby increasing the rate of combustion in vessel 20.

The combustion product gases generated in reactor 1 exit from the reactor via throat 21 in cyclonic combustor vessel. Substantially all of the granular bed material and uncombusted matter are separated from the combustion product gases and are retained within vessel 20, collected in lower region 22 and recycled to lower region 11 of chamber 10, preferably under the force of gravity via port 23. Alternately, any conventional solids transfer mechanism capable of preventing flue gases from entering into vessel 20 from chamber 10 may be used to recycle the solids back to chamber 10.

A key advantage of the fluidized bed combustor 1 of the present invention is that the cross-sectional areas of each of the upper region 16 of chamber 10 and the upper region 18 of vessel 20 are significantly smaller than the corresponding cross-sectional area of the upper region, i.e., the free board region, and the cyclone particle separator, respectively, of a conventional circulating fluidized bed combustor of the same capacity. This results in a significant savings in construction costs for the fluidized bed combustor of the present invention.

The above-described size reduction is accomplished by, for example, applying conventional circulating fluidized bed design criteria to size combustion chamber 10 and vessel 20 to operate at, for example, 25% of the desired capacity. That is, upper region 16 of chamber 10 and upper region 18 of vessel 20 may be sized to handle only, for example, 25% of the air flow associated with a conventional circulating fluidized bed combustor free board region and cyclone particle separator, respectively, of the desired capacity. This significant reduction in size is made possible by using vessel 20 as both a cyclone particle separator and a cyclonic combustor. Where, to continue the example, combustion chamber 10 and vessel 20 are reduced in size to handle only 25% of the conventional air flow, the remaining 75% of the conventional air flow is supplied as the second stream of air fed tangentially to cyclone combustor vessel 20 via openings 29 for cyclonic combustion of the major portion of the combustible matter in vessel 20.

Thus, by selecting the relative amounts of air supplied to combustor 1 via fluidizing air nozzles 12 in combustion chamber 10 and via tangential openings 19 in cyclonic combustor vessel 20, it is possible, in accordance with the present invention, to reduce the volume of air flowing through chamber 10 and into vessel 20 via tangential conduit 14 and thereby proportionally reduce the cross-sectional areas of upper regions 16 and 18, compared to the corresponding cross-sectional areas of the free board region and the cyclone separator of a conventional circulating fluidized bed combustor.

As shown, the embodiment depicted in FIG. 1 may comprise an adiabatic combustor for generation of hot combustion gases, i.e., without any heat extraction from combustion chamber 10 or cyclonic combustor vessel 20. The hot gases may, for example, be used as process heat supply or supplied to heat a boiler, as known in the art. Such an adiabatic combustor operates at high excess air, with the level of excess air depending on the heating value of the fuel being burned.

The combustion temperature in cyclonic combustor vessel 20 is controlled by controlling the fuel to air ratio. The desired temperature difference between chamber 10 and vessel 20, which will vary from case to case, is controlled by maintaining the proper mean particle size of the granular bed material and by controlling the fluidizing air superficial velocity in chamber 10 to provide a mean particle suspension density in chamber 10 and vessel 20 sufficient to sustain the desired temperature difference for the particular fuel being utilized.

Figure 11:
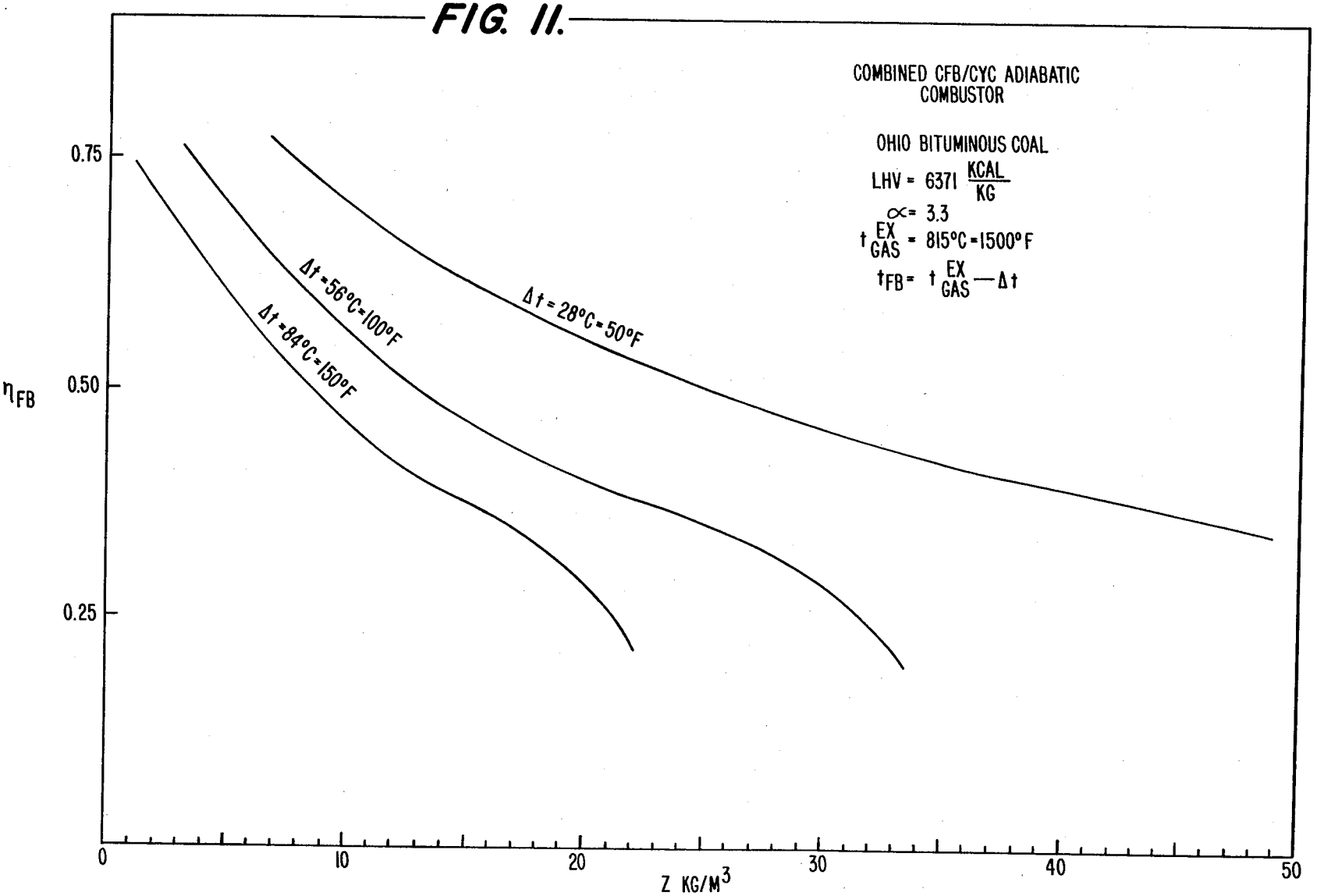
FIGS. 11–13 are graphs plotting particulate loading vs. the fraction of air supplied as fluidizing air for three combustor embodiments of the invention.

FIG. 11 is a graph showing the particulate loading ($KG/M^3$) of fluidized bed granular material in upper region 16 of combustion chamber 10 and upper region 18 of cyclonic combustor vessel 20 for combustor 1 shown in FIG. 1 as a function of the fraction ($\eta$) of the total air flow into the combustor that is introduced as fluidizing air via nozzles 12 in the bottom of chamber 10 for temperature differences ($\Delta T$) between chamber 10 and vessel 20 of 50° F. (28° C.), 100° F. (56° C.) and 150° F. (84° C.) This graph was prepared based on calculations for Ohio bituminous coal having a low heating value (LHV) of 6371 KCAL/KG, an air stoichiometric coefficient ($\alpha$) of 3.3 and assuming the temperature of the flue gases exiting from combustor 1 via exit throat 21 is 1500° F. for the adiabtic combustor of FIG. 1.

As can be seen from FIG. 11, for $\eta=0.25$, a temperature difference of 100° F. or 150° F. can be maintained between chamber 10 and vessel 20 by maintaining the particulate loading at about 31 $KG/M^3$ and 21 $KG/M^3$, respectively, using conventionally known techniques, for example, by controlling mean particle size and fluidizing air superficial velocity.

The method of the present invention can also be used for boiler applications which, from an economic standpoint, require low excess air for combustion and, therefore, heat absorption in the fluidized bed. In one embodiment of the invention, such heat absorption is accomplished by installing a heat exchange surface in upper region 16 of combustion chamber 10. As shown, for example, in the dashed lines in FIG. 1, the heat exchange surface may comprise a heat exchanger tube arrangement 25. The tube arrangement may be of any suitable size, shape and alignment, including a vertical tube wall, as is well known in the art. Preferably, heat exchanger tube arrangement 25 will be operatively connected to a process heat supply or to a conventional boiler drum (not shown) for boiler applications. The heat exchanger cooling media may comprise any suitable conventional liquid or gaseous media, such as, for example, water or air.

In boiler applications, the exhaust gases exiting from combustor 1 (FIG. 1) are preferably fed to the boiler convective tube bank in a conventionally known manner.

In the embodiment of FIG. 1, if heat exchanger tube arrangement 25 is provided in upper region 16 of chamber 10, the combustion temperature in cyclonic combustor vessel 20 is controlled by controlling the fluidizing air flow rate through plenum 15 at a given tangential air flow rate in upper region 18 of cyclonic combustor 20. This, in turn, controls the amount of solid particulate carryover from upper region 16 to upper region 18 via tangential conduit 14 and, consequently, the heat transfer coefficient of heat exchanger tube arrangement 25 is changed.

In the embodiment shown in FIG. 1 utilizing optional heat exchanger tube arrangement 25, combustor capacities below 100% are achieved by sequentially reducing the tangential air flow in vessel 20 and then reducing the fluidizing air flow through nozzles 12 in chamber 10.

Figure 12:
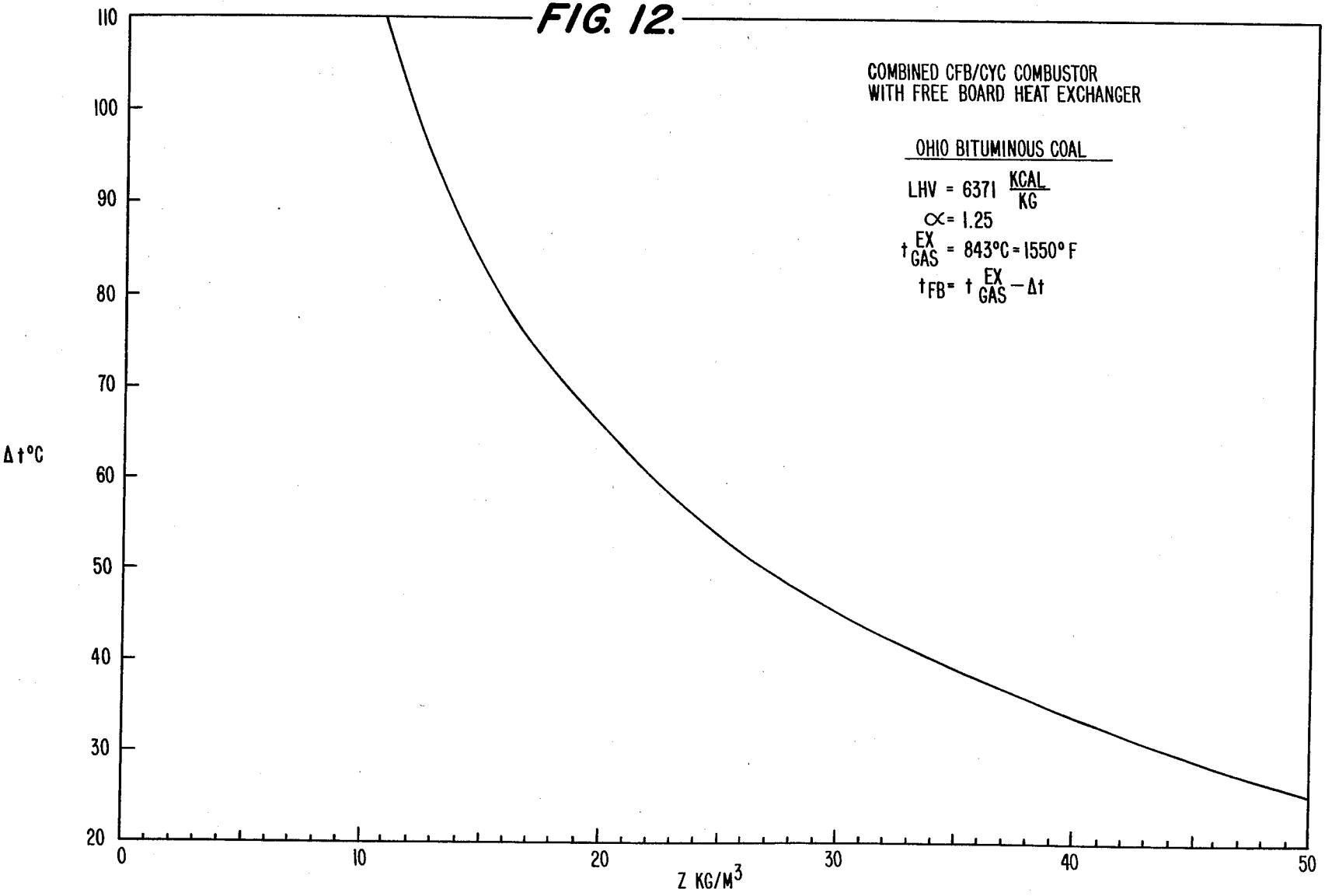

FIG. 12 is a graph showing the temperature difference in degrees Celsius ($\Delta T$) between vessel 20 (essentially the temperature of the flue gases exiting via throat 21) and chamber 10, (essentially the temperature in upper region 16) as a function of the particulate loading ($KG/M^3$) of fluidized bed granular material in the flue gases in the upper region 16 of chamber 10, for the FIG. 1 embodiment utilizing heat exchanger tube arrangement 25. This graph was prepared based on calculations for Ohio bituminous coal having a LHV of 6371 KCAL/KG, an $\alpha$ of 1.25 and assuming the temperature of the flue gases exiting via exit throat 21 is 1550° F. for the combustor of FIG. 1 with heat exchanger tube arrangement 25 installed.

As can be seen from FIG. 12, a very wide range of temperature differences between chamber 10 and vessel 20, 25° C. (45° F.) to 84° C. (150° F.), can be achieved if the particulate loading is varied between 50 $KG/M^3$ and 15 $KG/M^3$, respectively. Such temperature differences do not depend upon the value of $\eta$, the fraction of the total air flow that is introduced as fluidizing air (as described above), but rather, depend upon the particulate loading Z. Consequently, such a combustor can be designed with $\eta \leqq 25\%$ and a relatively low air superficial velocity in chamber 10, provided the particulate loading is maintained at least at 15 $KG/M^3$, for example, a temperature difference ($\Delta T$) limit of 150° F. for a given combustor design.

Figure 2:
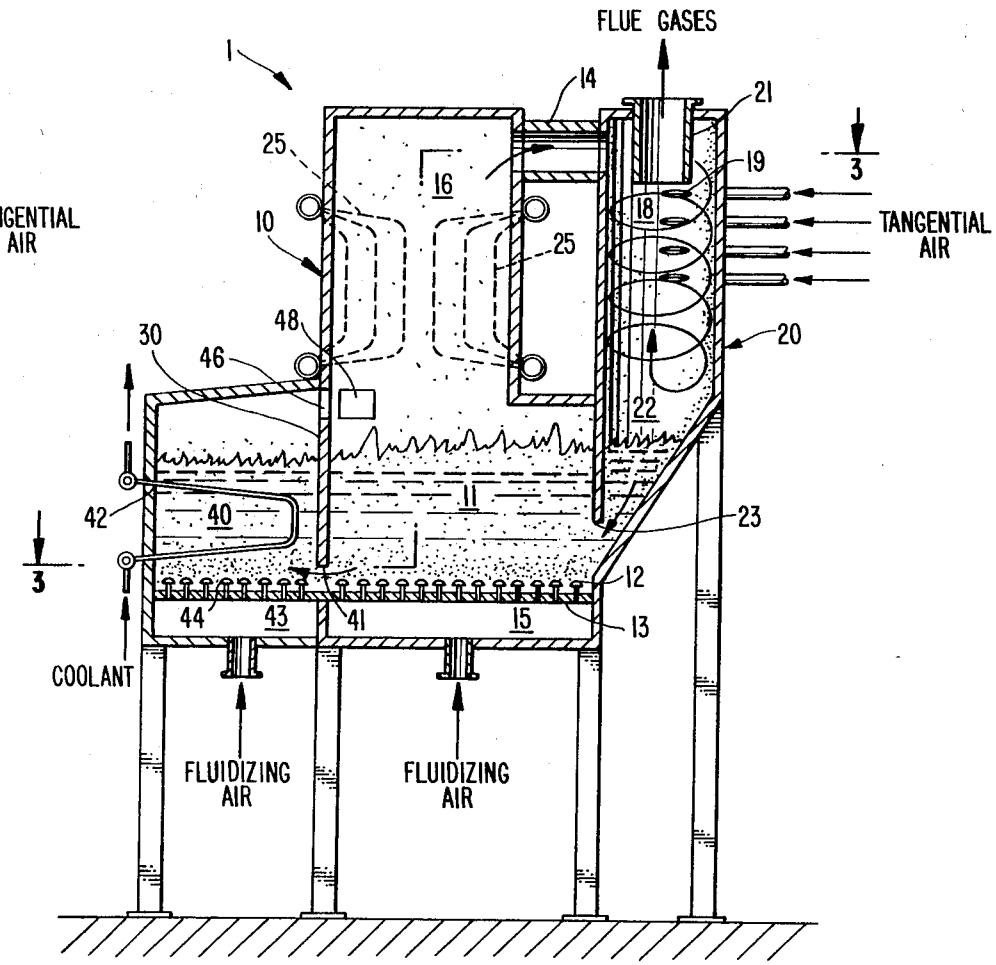
FIG. 2 is a diagrammatic vertical section view of a circulating fluidized bed reactor constructed in accordance with the invention.
Figure 3:
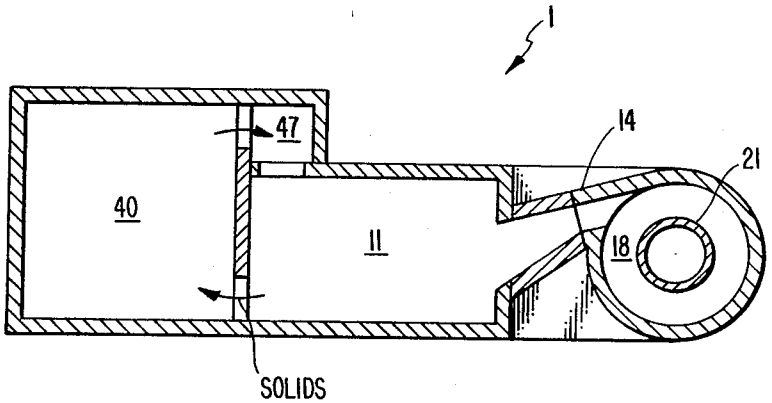
FIG. 3 is a diagrammatic plan cross sectional view A-B-C-D of the circulating fluidized bed reactor depicted in FIG. 2.
Figure 5:
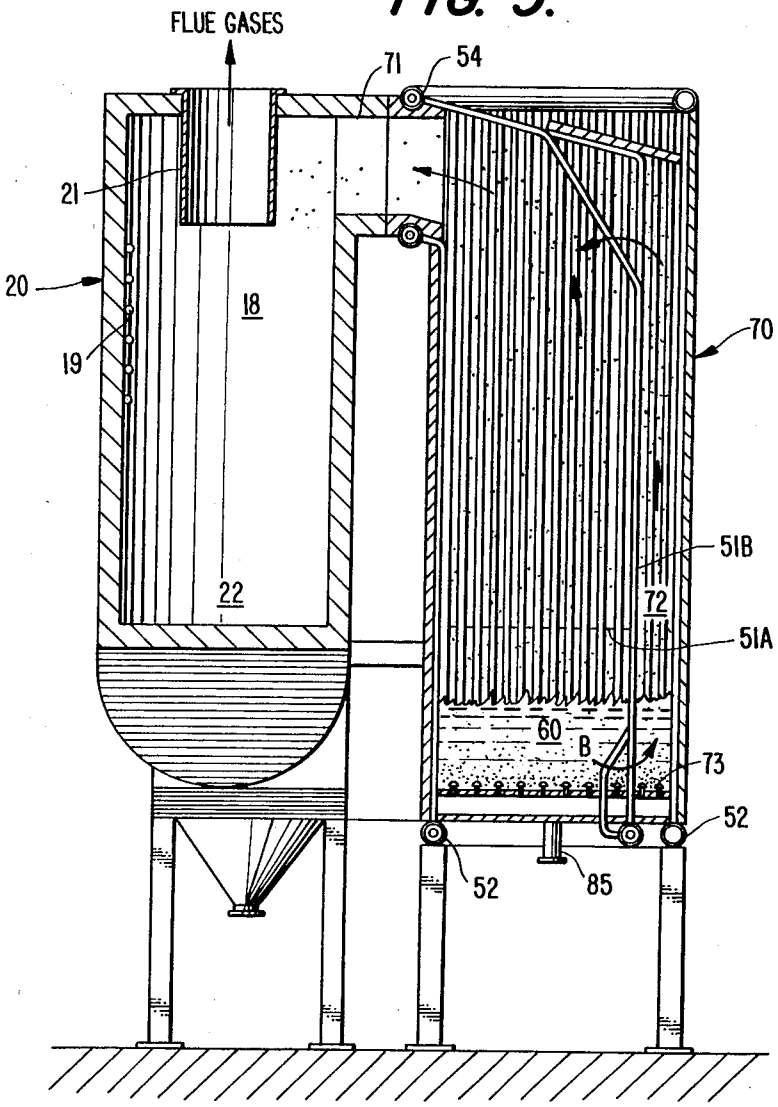
FIGS. 5, 6 and 7 are further diagrammatic vertical section views of the circulating fluidized bed reactor depicted in FIG. 4.

Turning now to FIGS. 2 and 3, these figures illustrate an embodiment of the invention particularly suitable for use in boiler applications in which a high boiler turndown ratio is desired. Like reference numerals have been used in FIGS. 2 and 3 to identify elements identical, or substantially identical, to those depicted in FIG. 1, and only those structural and operational features which serve to distinguish the embodiment shown in FIGS. 2 and 3 from those shown in FIG. 1 will be described below.

In particular, the embodiment shown in FIGS. 2 and 3 includes a cooling fluidized bed 40 (with a heat exchanger) situated immediately adjacent to region 11 of combustion chamber 10 and separated therefrom by a partition 30 having an opening 41 communicating with lower region 11. Cooling fluidized bed 40 comprises an ordinary (i.e., bubbling) fluidized bed of granular material, and includes a heat exchange surface, e.g., shown here as heat exchanger tube arrangement 42, which contains water or another coolant fluid, such as, for example, steam, compressed air, or the like. The bed 40 is fluidized by tertiary pressurized air supplied from a plenum 43 through openings 44 in a support surface. As shown, these openings may take the form of nozzles.

Fluidized bed 40 is comprised of the granular material and other solids flowing from lower region 11 into bed 40 through opening 41, as will be explained below by referring to both FIG. 2 and FIG. 3. Combustion also takes place in fluidized bed 40. Heat exchanger tube arrangement 42 functions as a cooling coil to cool fluidized bed 40. The cooled solids and combustion gases leave bed 40 through openings 45 and 46, respectively, in partition 30 which separates bed 40 from the circulating fluidized bed contained in lower region 11, and re-enter lower region 11 of reactor chamber 10. The solids are again fluidized therein. The fluid passing through tube arrangement 42 is preferably supplied from, for example, a conventional boiler drum (not shown) and after being heated and partially vaporized, is returned to the boiler drum. The fluid passing through the tube arrangement 42 may also typically comprise steam for superheating or air for generation of compressed air.

The movement of solids from the bubbling fluidized bed 40 to the circulating fluidized bed in lower region 11 of combustion chamber 10 is preferably motivated by specially designed solids reinjection channel 47 (see FIG. 3) having a high solids reinjection rate capability for reinjection of solids back into lower region 11 via port 48. Reinjection channel 47 has separately fed fluidizing nozzles (not shown) beneath it, with the solids reinjection rate being controlled by controlling the amount of air fed through these nozzles.

Fluidized bed 40 may optionally consist of two or more separate beds which may be interconnected or not, as desired, with each having a separate tube arrangement.

For a better understanding of how this boiler embodiment functions to improve the turndown ratio, a preferred procedure for initially placing it into operation from the cold condition to a full load and then turn it down to a desired level will be explained.

An ignition burner (not shown), which may be located above or under the fluidized bed level in lower region 11, is turned on along with the first (fluidizing) air stream (nozzles 12), with the second air stream (nozzles) 19, the cooling bed fluidizing air stream (nozzles 44) and the solids reinjection air stream being shut off. When the combustor's refractory in chamber 10 and its internal volume temperature exceed the solid fuel ignition temperature, the fuel is fed into combustion chamber 10.

After the solid fuel is ignited and, consequently, the combustor's exit gas temperature has risen to the design level, the ignition burner is turned off, and from this moment an adiabatic fluidized bed combustor scheme is in operation at a high excess air and having a capacity lower than the minimum designed capacity.

To reduce the high excess air to the design level, the fuel feed rate is increased, and to maintain the combustion temperature at a constant level, the cooling bed fluidizing air and the solids reinjection air flow through channel 47 are turned on and are kept at the required rate. From this moment the combustor is in operation at its minimum designed capacity with the corresponding design parameters.

To increase the unit's capacity, at this time the air flow in the second stream (nozzles 19) is gradually increased, with a simultaneous increase in the solid fuel feed rate, and a corresponding increase in the solids reinjection air flow rate through channel 47 to maintain the combustion temperature constant. When the second stream flow rate achieves its maximum design level, the combustor can be considered as having its full load (100% capacity).

At this moment, if the gas exit temperature is at the desired, i.e., design, level, the second stream air flow and fuel rate are not increased any further, and are then maintained in accordance with the fuel-air ratio required to obtain the most economical fuel combustion.

The minimum capacity of the reactor, i.e., desired turndown ratio, can be obtained if the sequence of operations outlined above is followed in reverse order, until the point where the ignition burner is shut off. Namely, while maintaining the desired fuel-air ratio, the second stream air flow (nozzles 19) is reduced until it is completely shut off. At the same time, the solids reinjection air is decreased proportionately to maintain the combustion temperature at a constant level. As a result, the solids' circulation through cooling fluidized bed 40 is reduced to a minimum corresponding to the combustor's minimum designed capacity, and likewise the heat exchange process between bed 40 and heat exchanger tubes 42 is reduced.

In brief review, the key feature, in terms of obtaining a high turndown ratio according to the embodiment depicted in FIG. 2, is the fact that the cooling fluidized bed heat exchange surface 42 may be gradually pulled out (but not physically) from the combution process so as to keep the fuel-air ratio and combustion temperature at the required levels.

Furthermore, the above-desired boiler turndown ratio improvement has an additional advantage over known circulating fluidized bed boilers. Specifically, it requires less than one-half the heat exchange surface to absorb excessive heat from the circulating fluidized bed, due to the following: (a) the tubular surface 42 immersed in fluidized bed 40 is fully exposed to the heat exchange process, versus the vertical tube-lined walls in the upper region of the combustion chamber of prior art circulating fluidized bed boilers, in which only 50% of the tube surface is used in the heat exchange process; (b) the fluidized bed heat exchange coefficient in such a system is higher than that for gases, even heavily loaded with dust, and vertical tube-lined walls confining the combustion chamber of prior art circulating fluidized bed boilers. The latter results, in part, from the fact that it is possible, by using a separate fluidized bed 40, to utilize the optimum fluidization velocity therein, and the fact that fluidized bed 40 is comprised of small particles, for example, fine ash and limestone.

Figure 13:
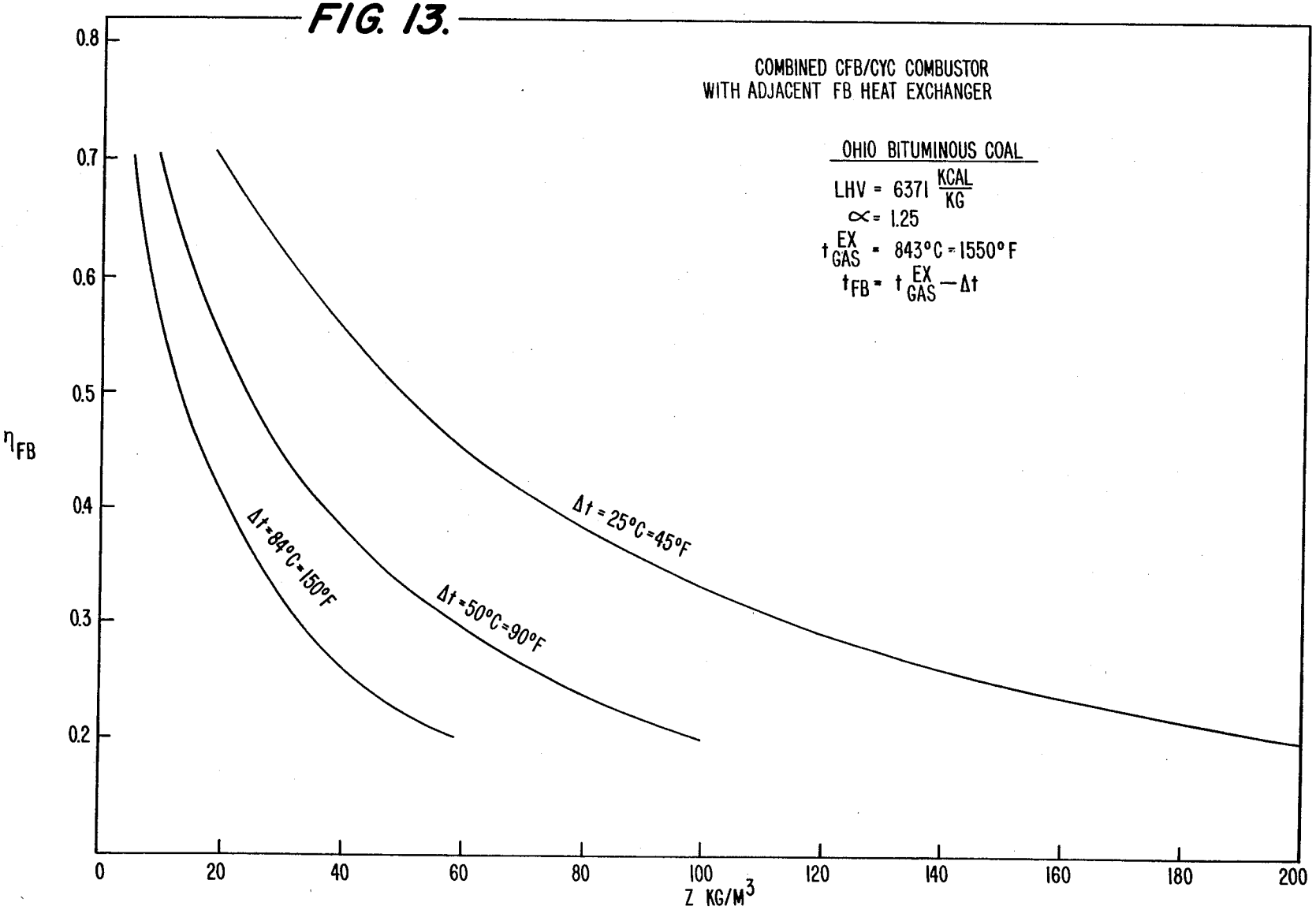

FIG. 13 is a graph showing the particulate loading ($KG/M^3$) of fluidized bed granular material in upper region 16 of combustion chamber 10 and upper region 18 of cyclonic combustor vessel 20 for combustor 1 shown in FIG. 2 as a function of the fraction $\eta$ of the total air flow into the combustor that is introduced as fluidizing air via nozzles 12 and 44 in the bottom of chamber 10 for temperature differences between chamber 10 and vessel 20 of 45° F. (20° C.), 90° F. (50° C.) and 150° F. (84°=C.). This graph was prepared based on calculations for Ohio bituminous coal having an LHV of 6371 KCAL/KG, an $\alpha$ of 1.25 and assuming the temperature of the flue gases exiting from combustor 1 via exit throat 21 is 1550° F.

As can be seen from FIG. 13, for $\eta=0.25$, a temperature difference of 90° F. or 150° F. can be maintained between chamber 10 and vessel 20 by maintaining the particulate loading at about 75 $KG/M^3$ and 44 $KG/M^3$, respectively, using conventionally known techniques as described previously.

In another embodiment of the invention, heat absorption from the fluidized bed through the use of an adjacent cooling fluidized bed 40 (FIG. 2) and by additionally installing a heat exchange surface in upper region 16 of combustion chamber 10. As shown, for example, in the dashed lines of FIG. 2 (indicating its optional nature), the heat exchange surface may comprise a heat exchanger tube arrangement 25. The constructional and operational features of tube arrangement 25, as well as its interaction with the other features of combustor 1 are the same as discussed previously in connection with FIG. 1.

FIGS. 4–7 illustrate a further embodiment of the present invention for achieving high capacity without requiring an excessively tall or otherwise large unit. This embodiment provides more heat transfer than the other embodiments discussed previously. Like reference numerals have been used to identify elements identical, or substantially identical, to those depicted in FIGS. 1 and 2.

In this embodiment, combustion chamber 10 is constructed and functions virtually identically to chamber 10 in the other embodiments of the invention. Preferably, no heat exchange surface is present in chamber 10 and conduit 14 extends from upper region 16 into the top of a substantially upright, cooling chamber 50 containing a heat exchange surface. As shown, the heat exchange surface preferably comprises conventional heat exchanger tube lined walls 51. Inlet headers 52 and outlet headers 54 are provided for tube lined walls 51. Optionally, upper region 16 of chamber 10 may also contain similar heat exchanger tube lined walls (not shown).

The combustion product gases and the granular bed material and unburnt combustible matter entrained therein exit chamber 10 through conduit 14 and descend along with the flue gases, through second chamber 50. At the bottom of chamber 50 is a fluidized bed 60 fluidized in the bubbling, i.e., non-circulating, regime. Tube lined walls 80 preferably surround and serve to contain fluidized bed 60.

Figure 4:
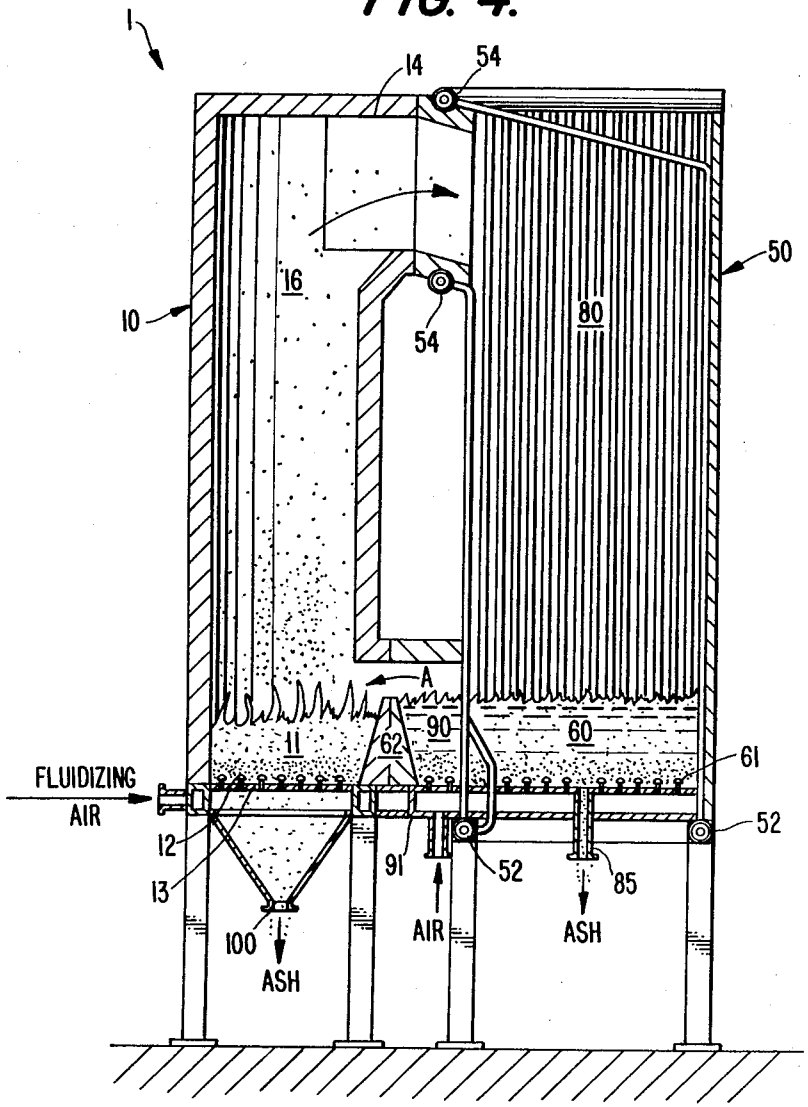
FIG. 4 is a diagrammatic vertical section view of a circulating fluidized bed reactor according to a further embodiment of the invention.
Figure 7:
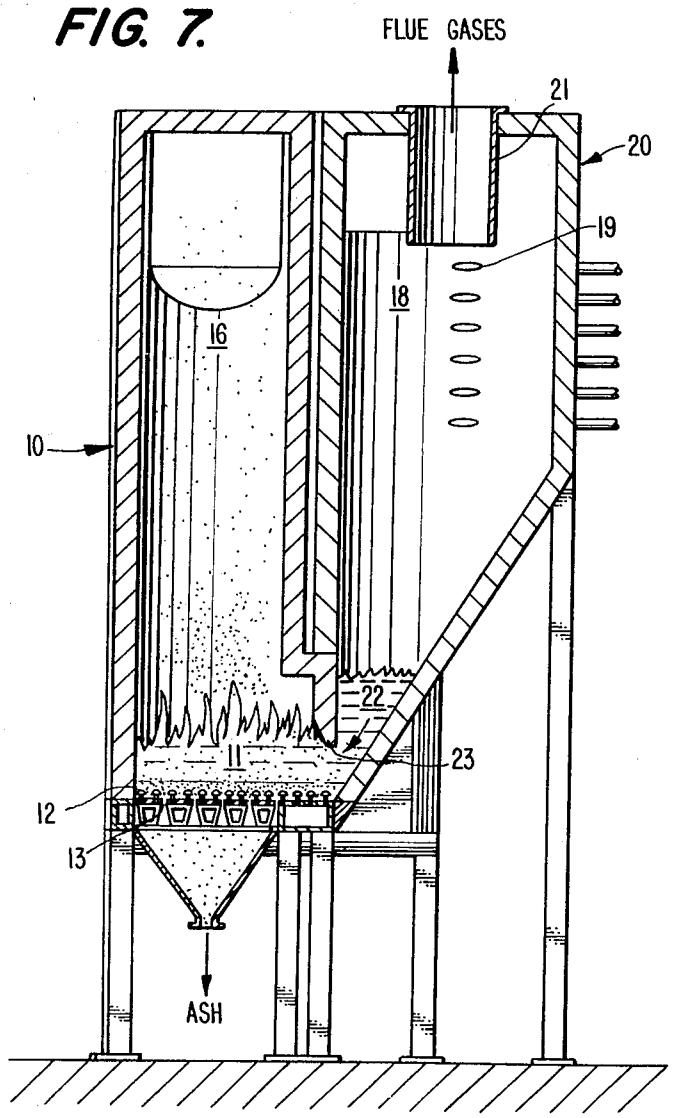
Figure 6:
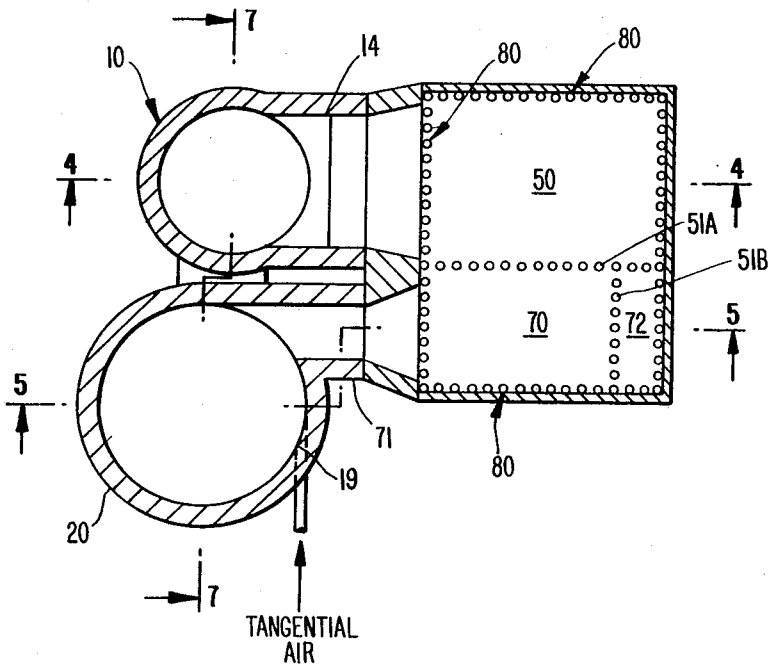

As shown best in FIG. 4, fluidized bed 60 is in solids, but not in gas communication with the circulating fluidized bed in chamber 10 through the overflow opening (denoted by the arrow A in FIG. 4) between chamber 10 and chamber 50. By controlling the vertical height of fluidized bed 60, which is accomplished by controlling the fluidizing air flow through nozzles 91 beneath bed 90, varying amounts of bed material from bed 60 can be made to overflow wall 62 into lower region 11 of chamber 10. As a result of the heat exchange that takes place as the combustion product gases, granular bed material and unburnt combustible matter pass through cooling chamber 50, the solids overflowing wall 62 into lower region 11 will have a lower temperature than the solids in chamber 10. Consequently, the temperature in chamber 10 can be regulated in part by controlling the amount of solids overflowing wall 62 into chamber 10.

Immediately adjacent to the cooling chamber 50 is a substantially upright second cooling chamber 70. Chambers 50 and 70 share a common, interior tube linedwall 51A. Wall 51A is preferable constructed as a tube sheet having fins extending between the tubes to render the tube sheet substantially impervious from its uppermost point downward to a height just above the top of fluidized bed 60 where there are no fins between the tubes, thus permitting passage of gases from the lower region of chamber 50 into the lower region of second cooling chamber 70. Thus, in the lower region of cooling chamber 50, above fluidized bed 60, the gases descending through chamber 50 effectively make a U-turn, entering second cooling chamber 70 above fluidized bed 60 at the bottom of chamber 70.

In second cooling chamber 70, combustion product gases flow upward and then out from the upper region of chamber 70 via tangential conduit 71 into the upper region 18 of a cyclonic combustor vessel 20. Vessel 20 is constructed and functions virtually identically to vessel 20 in the other embodiments of the invention previously discussed, with the solids collected at the bottom of vessel 20 being recycled under the force of gravity through port 23 into the lower region 11 of chamber 10 (see FIGS. 5 and 6). Alternatively, any similar conventional device, such as, for example, a non-mechanical sluice, may also be used.

An upflow channel 72 is created within or adjacent chamber 70. As embodied herein, channel 72 is formed by providing an inner wall 51B (FIGS. 5 and 6), which preferably comprises a tube lined wall as shown. Wall 51B is open at its upper end and contains a lower opening for permitting fluidized bed solids, including the granular bed material and unburnt combustible matter, to enter channel 72 (as shown by arrow B in FIG. 5). At the bottom of channel 72 are fluidization gas nozzles 73 for fluidizing in the pneumatic transport regime. The solids in channel 72 are thus entrained upwardly in the fluidization gases and exit from the open upper end of channel 72 into the upper region of chamber 70 (as shown by arrow C in FIG. 5). At this point, these elevated solids are entrained by the ascending gases in chamber 70 and are carried out of chamber 70 via conduit 71. The velocity of the ascending gases must, thus, be sufficiently high to permit such carryover of the solids issuing from the top of channel 72. Preferably, such velocity is sufficiently high, and channel 72 is constructed and operated, so as to provide a rate of particulate solids entry into cyclonic combustor vessel 20 via tangential conduit 71 substantially equal to, or greater than, the rate of particulate solids exiting from combustion chamber 10 via conduit 14.

The internal cross-sectional area of combustion chamber 10 can be significantly smaller than the free board region of a conventional circulating fluidized bed combustor; typically 4 to 5 times smaller, with respect to its cross-sectional area.

In operation of the embodiment depicted in FIGS. 4–7, the superficial gas velocity is very high in chamber 10 for providing the desired particulate solids loading in the combustion product gases exiting via conduit 14. The downward superficial gas velocity in first cooling chamber 50, which is less than that in combustion chamber 10, is not high enough to cause damaging erosion of tube lined walls 51A, 80 or any other heat transfer surface installed in cooling chamber 50. The same is true for the upward superficial gas velocity in second cooling chamber 70.

The combustion product gases entering first cooling chamber 50 via conduit 14 are very heavily laden with solid particles (i.e., high particulate solids loading), thereby providing a high heat transfer coefficient in conjunction with tube lined walls 51A, 80 despite the somewhat lower gas velocity than in combustion chamber 10.

The combustion product gases flowing upward through second cooling chamber 70 have a sufficient velocity to provide the desired particulate solids loading for the gases entering cyclonic combustor vessel 20 via tangential conduit 71, i.e., loading selected to maintain the desired combustion temperature in vessel 20. Such loading is controlled by the velocity of upwardly flowing gases in chamber 70 and the amount of particulate solids exiting from the top of channel 72, as described previously.

A portion of the solids carried by the gases in first and second cooling chambers 50, 70 will separate from the gases and fall into bubbling fluidized bed 60. Tramp material and ash building up in the bed is periodically removed via conduits 85 and 100 in a conventionally known manner. The fluidized bed material inventory in bed 60 is maintained at the desired levels by overflowing the bed material from bed 60 into the lower region 11 of combustion chamber 10, as previously described.

Combustion takes place in combustion chamber 10 and cyclonic combustor vessel 20 as described in connection with the embodiments of FIGS. 1 and 2, with the majority of the combustion taking place in vessel 20. For example, in one preferred embodiment, in excess of about 70% of the total air fed to combustor 1 is fed via tangential air inlets 19 in vessel 20.

The capacity of the combustor shown in FIGS. 4–7 can be turned down from 100% capacity, and vice-versa, in substantially the same manner as described previously in connection with the embodiments of FIGS. 1 and 2.

Figure 9:
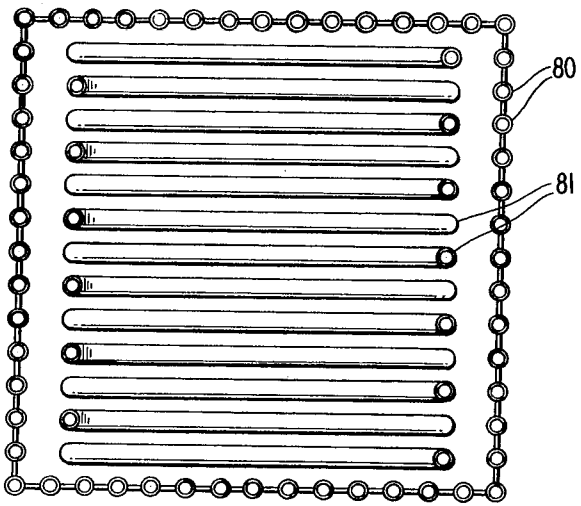
FIGS. 8 and 9 are diagrammatic front section and top section views, respectively, of an alternative heat exchanger tube arrangement suitable for use in the reactor shown in FIGS. 4–7.
Figure 8:
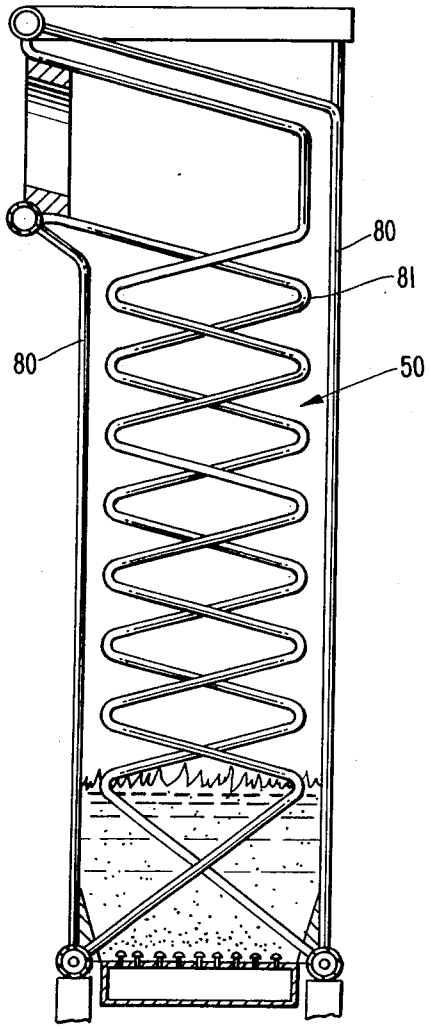

As explained above, in the embodiment shown in FIGS. 4–7, the velocity of the combustion product gases in first cooling chamber 50 is less than the gas superficial velocity in combustion chamber 10. However, the gas velocity in chamber 50 is not high enough to create an erosion problem with any internal heat transfer surface. In an alternative embodiment of the invention shown in FIGS. 8 and 9, the heat transfer surface in first cooling chamber 50 comprises both heat exchanger tube-lined walls 80 and serpentine-like tubular heat exchanger coils 81 installed inside the chamber. This embodiment permits the height of first cooling chamber to be reduced and utilizes a more compact heat transfer surface. Combustion gases heavily laden with the particulates entrained out of combustion chamber 10 via conduit 14 flow downward between the serpentine coils 81 which are preferably inclined at 12°–15° for natural water circulation. This heat exchanger coil arrangement provides minimum obstruction to gas flow and does not require any practical increase in the chamber's cross-sectional area at a given gas velocity, compared with an arrangement in which the heat exchanger coils are aligned horizontally. Moreover, such a horizontal tube alignment does not provide natural water circulation. On the other hand, a strictly vertical arrangement of coils 81 would require a multiplicity of tubes and very large headers.

Figure 10:
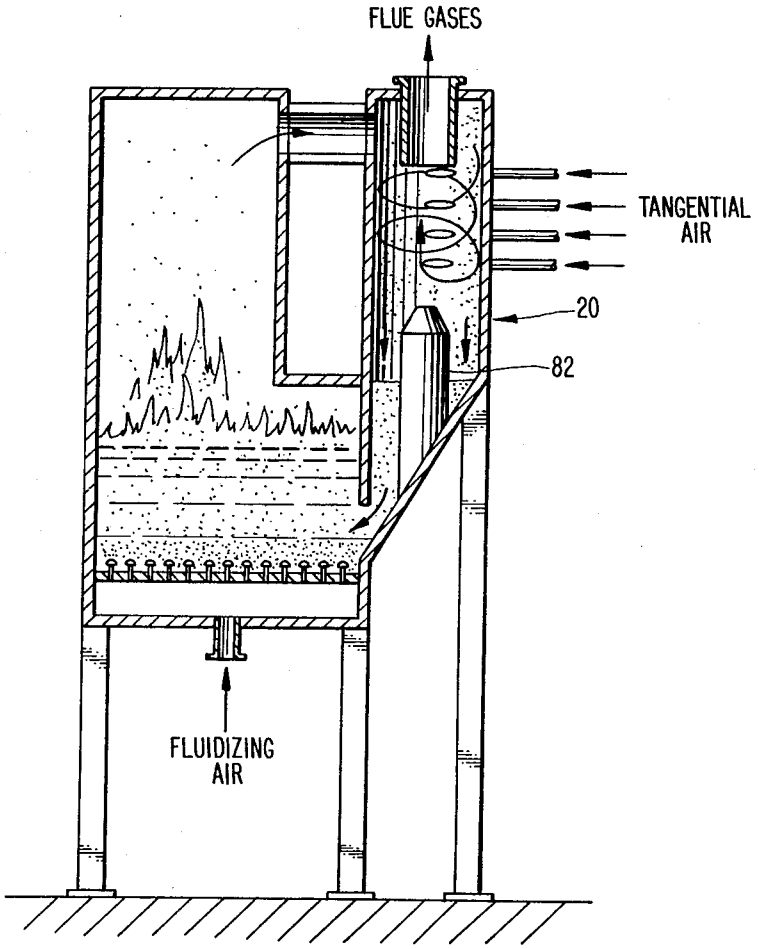
FIG. 10 is a diagrammatic vertical section view of a circulating fluidized bed reactor constructed in accordance with a further embodiment of the invention.

FIG. 10 depicts a further embodiment of the invention having enhanced particle separation efficiency in the cyclonic combustor vessel. Except where noted below, the structure and operation of combustor 1 are virtually identical to those shown in FIG. 1, and like reference numerals have been used to identify elements identical, or substantially identical, to those depicted in FIG. 1.

As discussed previously, cyclonic combustor vessel 20 also performs a gas-solids separation function. In particular, the lower region 22 of vessel 20 has a downwardly converging shape (e.g., as a hopper) for collecting the particulate solids separated from the gases by the spinning flow in upper region 18. The solids slide down the interior surface of vessel 20 as a mass of bulk material which is discharged via port 23 back into the fluidized bed in lower region 11 of combustion chamber 10.

It is known in the art of cyclone separation that the effective operation of a conventional cyclone particle separator can be destroyed by gas (air) leakage upward into the separator through the particle collection hopper at the bottom of the separator. Such gas leakage into the bottom of the cyclone separator can, if large enough, provide an upwardly moving gas stream in the separator which can reduce the cyclone particle separation efficiency to zero.

In the combustor of the present invention, such undesirable gas leakage can also reduce the particle separation efficiency of cyclonic combustor vessel 20. The most destructive effect on separation efficiency is produced by leaked gases which pass upwardly through vessel 20 in the central core region of the vessel. To combat the passage of any leaked gases upward through the central core region, the embodiment shown in FIG. 10 is equipped with a substantially centrally located, vertically aligned, refractory column 82 having a diameter approximately equal to or somewhat less than that of exit throat 21. Column 82 functions to divert any gases which may leak into the bottom of vessel 20 away from the central region of the vessel. Column 82 preferably has a top portion which is frusto-conically shaped.

Gas diverter column 82 may obviously be utilized in any of the embodiments of the invention disclosed here or in the invention disclosed in my U.S. Pat. No. 4,457,289. For example, it may be installed in cyclonic combustor vessel 20 of the embodiment depicted in FIGS. 4–7.

It will be apparent to those of ordinary skill in the art that various modifications and variations can be made to the above-described embodiments of the invention without departing from the scope of the appended claims and their equivalents. As an example, although the invention has been described in the field of fluidized bed combustors, the invention can be used for other applications in which fluidized bed reactors are used, such as, for example, various chemical and metallurgical processes.

What is claimed is:

1. A method of operating a circulating fluidized bed combustion reactor, comprising:

providing a substantially enclosed combustion reactor containing a fluidized bed of granular material, said reactor comprising a substantially upright combustion chamber and a substantially upright and cylindrical cyclonic combustor vessel adjacent to said chamber, the respective upper regions of said chamber and said vessel being connected via a conduit and the respective lower regions of said chamber and said vessel being operatively connected, said vessel having a cylindrically shaped exit throat aligned substantially concentrically with, and at the top of, said vessel;

feeding combustible matter into said combustion chamber;

supplying a first stream of pressurized air to the reactor through a plurality of openings at the bottom of said combustion chamber at a sufficient velocity to fluidize said granular material and said matter in the circulating regime for combusting a minor portion of said matter in said chamber, whereby a substantial portion of said granular bed material, combustion product gases and uncombusted matter are continually entrained out of said chamber and into said cyclonic combustor vessel via said conduit;

tangentially supplying a second stream of pressurized air into the reactor through a plurality of openings in the cylindrically shaped interior side wall of said vessel for cyclonic combustion of a major portion of the combustible matter in said vessel, said second stream being supplied, and said vessel being constructed and operated, so as to produce a Swirl number of at least about 0.6 and a Reynolds number of at least about 18,000 within said vessel for creating a cyclone of turbulence therein having at least one internal reverse flow zone, thereby increasing the rate of combustion therein;

permitting the combustion product gases generated in the reactor to exit from the reactor via said exit throat in said cyclonic combustor vessel, while retaining substantially all of said granular material and uncombusted matter within the reactor;

collecting the granular bed material and any uncombusted matter in the lower region of said cyclonic combustor vessel and returning it to the lower region of said combustion chamber; and controlling the combustion process in the reactor by controlling the flow of said first and second streams of air into said combustion chamber and said cyclonic combustor vessel, respectively, and by controlling the flow of granular bed material and matter to be combusted in said chamber and said vessel.

2. A method as claimed in claim 1, wherein said second stream of air comprises between about 65% and about 85% of the total air fed to the reactor at maximum operating capacity.

3. A method as claimed in claim 1, further comprising the step of providing a heat exchange surface in the upper region of said combustion chamber for removing heat from said upper region.

4. A method as claimed in claim 1, wherein said plurality of openings for supplying said second stream of pressurized air are substantially vertically aligned and spaced apart along said side wall of said vessel.

5. A method as claimed in claim 1, further comprising the step of providing a vertically extending substantially cylindrical diverter column extending from the bottom of said cyclonic combustor vessel to a height sufficient to divert any gases entering said vessel from said lower region of said combustion chamber away from the central axis of said vessel, said column having a diameter substantially equal to or somewhat less than the interior diameter of said exit throat.

6. A method as claimed in claim 1, wherein said matter to be combusted includes solid combustible material.

7. A method as claimed in claim 6, wherein the total pressurized air supplied to the reactor is in excess of the stoichiometric amount needed for combustion.

8. A method as claimed in claim 1, further comprising the steps of providing a separate second fluidized bed situated within the reactor and adjacent to the lower region of said combustion chamber, said second fluidized bed being separated from the fluidized bed in said combustion chamber by a substantially vertically extending partition and being fluidized in the bubbling regime;

permitting the fluidized granular material to flow from said combustion chamber into said second fluidized bed via a first opening in said partition;

permitting the fluidized granular material to flow from said second fluidized bed into the fluidized bed in said combustion chamber via a second opening in said partition; and providing a heat exchange surface immersed in said second fluidized bed for removing heat therefrom.

9. A method as claimed in claim 8, including the step of supplying the heat removed from said second fluidized bed to a boiler or process heat supply.

10. A method as claimed in claim 1, wherein said matter to be combusted includes liquid combustible material.

11. A method as claimed in claim 1, wherein said matter to be combusted includes gaseous combustible material.

12. A method as claimed in claim 10 or 11, wherein said liquid or gaseous material is fed directly into said cyclonic combustor vessel.

13. In a method of operating a substantially upright fluidized bed combustion reactor having a combustion chamber and an adjacent gas-solids separator, said chamber containing combustible matter and a bed of granular material fluidized in the circulating regime by a first stream of pressurized air so as to entrain a substantial portion of said granular material, combustion product gases and uncombusted matter upwardly out of said chamber and into said gas-solids separator for separating said entrained portion of the granular material from said gases in said separator and returning the separated granular material to said combustion chamber, said gas-solids separator having a substantially cylindrical interior surface, the improvement comprising:

creating in said separator a cyclonic flow of turbulent gases, uncombusted matter and granular material having at least one internal reverse flow zone by tangentially introducing a second stream of pressurized air into said separator through a plurality of openings in said interior surface of said separator for cyclonic combustion of the uncombusted matter contained therein, said second stream of air and the geometrical configuration of said interior surface of said separator being jointly adapted to maintain a Swirl number of at least about 0.6 and a Reynolds number of at least about 18,000 within said separator;

combusting a minor portion of the combustible matter in said chamber and a major portion of the combustible matter in said separator by controlling the flow of said first and second streams of air into said chamber and said separator, respectively, and by controlling the flow of granular bed material and combustible matter to said chamber and said vessel; and permitting the combustion product gases generated in said chamber and said separator to exit from said separator via a cylindrically shaped exit throat substantially concentrically with, and at the top of, said separator, while retaining substantially all of said granular material and uncombusted matter within said separator.

14. A method as claimed in claim 1 or 13, wherein said second stream of air comprises between about 65% and 85% of the total pressurized air fed to the reactor.

15. A method of operating a circulating fluidized bed reactor, comprising:

providing a substantially enclosed reactor containing a fluidized bed of granular material, said reactor comprising a substantially upright chamber and a substantially upright and cylindrical vessel adjacent to said chamber, the respective upper regions of said chamber and said vessel being connected via a conduit and the respective lower regions of said chamber and said vessel being operatively connected, said vessel having a cylindrically shaped exit throat aligned substantially concentrically with, and at the top of, said vessel;

feeding matter to be reacted into said reactor;

supplying a first stream of pressurized reaction-promoting gas to the reactor through a plurality of openings at the bottom of said chamber at a sufficient velocity to fluidize said granular material and said matter in the circulating regime for reacting a minor portion of said matter in said chamber, whereby a substantial portion of said granular bed material, reaction product gases and unreacted matter are continually entrained out of said chamber and into said vessel via said conduit;

tangentially supplying a second stream of pressurized reaction-promoting gas into the reactor through a plurality of openings in the cylindrically shaped interior side wall of said vessel for reacting a major portion of said matter, said second stream being supplied, and said vessel being constructed and operated, so as to produce a Swirl number of at least about 0.6 and a Reynolds number of at least about 18,000 within said vessel for creating a cyclone of turbulence therein having at least one internal reverse flow zone, thereby increasing the rate of the reaction;

permitting the reaction product gases generated in the reactor to exit from the reactor via said exit throat in said vessel, while retaining substantially all of said granular material and unreacted matter within the reactor;

collecting the granular bed material and any reacted matter in the lower region of said vessel and returning it to the lower region of said chamber; and maintaining the desired reaction in the reactor by controlling the flow of said first and second streams of reaction-promoting gas into said chamber and said vessel, respectively, and by controlling the flow of granular bed material and matter to be reacted in said chamber and in said vessel.

16. A method as claimed in claim 1, 13 or 15, wherein the interior surface of the reactor are refractory lined.

17. A method as claimed in claim 15, wherein said second stream of gas comprises in excess of about 50% of the total reaction-promoting gas fed to the reactor.

18. A method as claimed in claim 15, wherein said second stream of gas comprises between about 65% and 85% of the total reaction-promoting gas fed to the reactor.

19. A method of operating a circulating fluidized bed combustion reactor, comprising:

providing a substantially enclosed combustion reactor comprising: (a) a substantially upright and cylindrical combustion chamber containing a fluidized bed of granular material fluidized in the circulating regime, (b) a first cooling chamber adjacent to said combustion chamber and having a first heat exchange surface, (c) a second cooling chamber having a second heat exchange surface, said first and second cooling chambers having a common bubbling fluidized bed in their bottom regions, and (d) a substantially upright and cylindrical cyclonic combustor vessel adjacent and operatively connected to said second cooling chamber and operatively connected to said combustion chamber, said vessel having a cylindrically shaped exit throat aligned substantially concentrically with, and at the top of, said vessel;

permitting solids from said bubbling fluidized bed to flow into said circulating fluidized bed in said combustion chamber for controlling the temperature of the latter bed;

feeding combustible matter into said combustion chamber;

supplying a first stream of pressurized air to the reactor through a plurality of openings at the bottom of said combustion chamber at a sufficient velocity to fluidize said granular material and said matter in the circulating regime for combusting a minor portion of said matter in said combustion chamber, whereby a substantial portion of said granular bed material, combustion product gases and uncombusted matter are continually entrained upward and out of said chamber into said first cooling chamber;

passing said product gases and entrained solids downward through said first cooling chamber and removing heat therefrom via said first heat exchange surface, and permitting said entrained solids to enter said bubbling fluidized bed;

then passing said gases from said first cooling chamber to said second cooling chamber and permitting said gases to ascend through said second cooling chamber while removing heat therefrom via said second heat exchange surface;

entraining the solids containing said uncombusted matter in the ascending gases in said second cooling chamber and passing said gases and entrained solids out of said second cooling chamber and into the upper region of said cyclonic combustor vessel;

tangentially supplying a second stream of pressurized air into the reactor through a plurality of openings in the cylindrically shaped interior side wall of said vessel for cyclonic combustion of a major portion of the combustible matter fed to the reactor in said vessel, said second stream being supplied, and said vessel being constructed and operated, so as to produce a Swirl number of at least about 0.6 and a Reynolds number of at least about 18,000 within said vessel for creating a cyclone of turbulence therein having at least one internal reverse flow zone, thereby increasing the rate of combustion therein;

permitting the combustion product gases generated in the reactor to exit from the reactor via said exit throat in said cyclonic combustor vessel, while retaining substantially all of said granular material and uncombusted matter within the reactor;

collecting the granular bed material and any uncombusted matter in the lower region of said cyclonic combustor vessel and returning it to said combustion chamber; and controlling the combustion process in the reactor by controlling the flow of said first and second streams of air into said combustion chamber and said cyclonic combustor vessel, respectively, and by controlling the flow of granular bed material and matter to be combusted in said combustion chamber, said first and second cooling chambers, and said vessel.

20. A circulating fluidized bed combustion reactor, comprising:

(a) a substantially enclosed combustion reactor for containing a fluidized bed of granular material, said reactor comprising a substantially upright combustion chamber and a substantially upright and cylindrical cyclonic combustor vessel adjacent to said chamber, the respective upper regions of said chamber and said vessel being connected via a conduit and the respective lower regions of said chamber and said vessel being operatively connected;

(b) means for feeding combustible matter into said combustion chamber;

(c) means for supplying a first stream of pressurized air to the reactor through a plurality of openings at the bottom of said combustion chamber at a sufficient velocity to fluidize said granular material and said matter in the circulating regime for combusting a minor portion of said matter in said chamber, whereby a substantial portion of said granular bed material, combustion product gases and uncombusted matter are adapted to be continually entrained out of said chamber and into said cyclonic combustor vessel via said conduit;

(d) means for tangentially supplying a second stream of pressurized air into the reactor through a plurality of openings in the cylindrically shaped interior side wall of said vessel for cyclonic combustion of a major portion of the combustible matter in said vessel, said vessel being constructed for producing a Swirl number of at least about 0.6 and a Reynolds number of at least about 18,000 within said vessel for creating a cyclone of turbulence therein having at least one internal reverse flow zone, thereby increasing the rate of combustion therein;

(e) a cylindrically shaped exit throat aligned substantially concentrically with, and at the top of said vessel for permitting the combustion product gases generated in the reactor to exit from the reactor, while retaining substantially most of said granular material and uncombusted matter within the reactor; and (f) means for collecting the granular bed material and any uncombusted matter in the lower region of said cyclonic combustor vessel and returning it to the lower region of said combustion chamber.

21. A reactor as claimed in claim 20, wherein said means for collecting the granular bed material and uncombusted matter and returning it to the lower region of said combustion chamber comprises a hopper having an opening communicating with a port in the lower region of said combustion chamber.

22. A reactor as claimed in claim 20, further comprising a heat exchange surface in the upper region of said combustion chamber for removing heat from said upper region.

23. A reactor as claimed in claim 20, wherein said plurality of openings for supplying said second stream of pressurized air are substantially vertically aligned and spaced apart along said side wall of said vessel.

24. A reactor as claimed in claim 20, further comprising:

a separate second fluidized bed situated within the reactor and adjacent to the lower region of said combustion chamber, said second fluidized bed being separated from the fluidized bed in said combustion chamber by a substantially vertically extending partition and being fluidized in the bubbling regime;

means for permitting the fluidized granular material to flow from said combustion chamber into said fluidized bed via a first opening in said partition;

means for permitting the fluidized granular material to flow from said second fluidized bed into the fluidized bed in said combustion chamber via a second opening in said partition; and a heat exchange surface immersed in said second fluidized bed for removing heat therefrom.

25. A fluidized bed reactor as claimed in claim 22 or 24, further comprising boiler means operatively connected to said heat exchange surface.

26. A fluidized bed reactor as claimed in claim 20, further comprising a vertically extending substantially cylindrical diverter column extending from the bottom of said cyclonic combustor vessel to a height sufficient to divert any gases entering said vessel from said lower region of said combustion chamber away from the central axis of said vessel, said column having a diameter substantially equal to or somewhat less than the interior diameter of said exit throat.

27. A fluidized bed reactor as claimed in claim 26, wherein the top portion of said diverter column is frusto-conically shaped.

28. A circulating fluidized bed reactor, comprising:

(a) a substantially enclosed reactor containing a fluidized bed of granular material, said reactor comprising a substantially upright chamber and a substantially upright and cylindrical vessel adjacent to said chamber, the respective upper regions of said chamber and said vessel being connected via a conduit and the respective lower regions of said chamber and said vessel being operatively connected;

(b) means for feeding matter to be reacted into said reactor;

(c) means for supplying a first stream of pressurized reaction-promoting gas to the reactor through a plurality of openings at the bottom of said chamber at a sufficient velocity to fluidize said granular material and said matter in the circulating regime for reacting a minor portion of said matter in said chamber, whereby a substantial portion of said granular bed material, reaction product gases and unreacted matter are continually entrained out of said chamber and into said vessel via said conduit;

(d) means for tangentially supplying a second stream of pressurized reaction-promoting gas into the reactor through a plurality of openings in the cylindrically shaped interior side wall of said vessel for reacting a major portion of said matter, said second stream being supplied, and said vessel being constructed and operated, so as to produce a Swirl number of at least about 0.6 and a Reynolds number of at least about 18,000 within said vessel for creating a cyclone of turbulence therein having at least one internal reverse flow zone, thereby increasing the rate of the reaction;

(e) a cylindrically shaped exit throat aligned substantially concentrically with, and at the top of said vessel for permitting the reaction product gases generated in the reactor to exit from the reactor, while retaining substantially all of said granular material and unreacted matter within the reactor; and (f) means for collecting the granular bed material and any unreacted matter in the lower region of said vessel and returning it to the lower region of said chamber.

29. A substantially enclosed circulating fluidized bed combustion reactor, comprising:

a substantially upright and cylindrical combustion chamber containing a fluidized bed of granular material fluidized in the circulating regime;

a substantially upright first cooling chamber adjacent to said combustion chamber and having a first heat exchange surface;

a substantially upright second cooling chamber adjacent to said first cooling chamber and having a second heat exchange surface, said first and second cooling chambers having a common bubbling fluidized bed in their bottom regions;

a substantially upright and cylindrical cyclonic combustor vessel adjacent and operatively connected to said second cooling chamber and operatively connected to said combustion chamber, said vessel having a cylindrically shaped exit throat aligned substantially concentrically with, and at the top of, said vessel for permitting the combustion product gases to exit from the reactor, the respective upper regions of said combustion chamber and said first cooling chamber being connected via a conduit and the respective lower regions of said combustion chamber and said first cooling chamber being in solids communication, the respective bottom regions of said first cooling chamber and said second cooling chamber being in open solids and gas communication, and the respective upper regions of said second cooling chamber and said cyclonic combustor vessel being connected via a port;

means for permitting solids from said bubbling fluidized bed to flow into said circulating fluidized bed in said combustion chamber for controlling the temperature of the latter bed;

means for feeding combustible matter into said combustion chamber;

means for supplying a first stream of pressurized air to the reactor through a plurality of openings at the bottom of said combustion chamber at a sufficient velocity to fluidize said granular material and said matter in the circulating regime for combusting a minor portion of said matter in said combustion chamber, for continually entraining a substantial portion of said granular bed material, combustion product gases and uncombusted matter upward and out of said chamber and into said first cooling chamber via said conduit;

means for entraining the solids containing said uncombusted matter in the ascending gases in said second cooling chamber and passing said gases and entrained solids out of said second cooling chamber and into the upper region of said cyclonic combustor vessel via said port;

means for tangentially supplying a second stream of pressurized air into the reactor through a plurality of openings in the cylindrically shaped interior side wall of said vessel for cyclonic combustion of a major portion of the combustible matter fed to the reactor in said vessel, said vessel being adapted for producing a Swirl number of at least about 0.6 and a Reynolds number of at least about 18,000 within said vessel for creating a cyclone of turbulence therein having at least one internal reverse flow zone, for increasing the rate of combustion therein;

means for collecting the granular bed material and any uncombusted matter in the lower region of said cyclonic combustor vessel and returning it to said combustion chamber; and means for controlling the combustion process in the reactor by controlling the flow of said first and second streams of air into said combustion chamber and said cyclonic combustor vessel, respectively, and by controlling the flow of granular bed material and matter to be combusted in said combustion chamber, said first and second cooling chambers, and said vessel.

* * * * *